US009261809B2

(12) United States Patent
Furuta

(10) Patent No.: US 9,261,809 B2
(45) Date of Patent: Feb. 16, 2016

(54) IMAGE FORMING APPARATUS

(71) Applicant: CANON KABUSHIKI KAISHA, Tokyo (JP)

(72) Inventor: Yasutomo Furuta, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/308,397

(22) Filed: Jun. 18, 2014

(65) Prior Publication Data

US 2015/0002598 A1 Jan. 1, 2015

(30) Foreign Application Priority Data

Jun. 28, 2013 (JP) ..... 2013-137467

(51) Int. Cl.
*G03G 15/04* (2006.01)
*G03G 15/043* (2006.01)

(52) U.S. Cl.
CPC ..... *G03G 15/04072* (2013.01); *G03G 15/0435* (2013.01); *G03G 2215/0129* (2013.01)

(58) Field of Classification Search
CPC ..... G03G 15/0435; G03G 2215/0129; G03G 2215/150435; H04N 1/04; B41J 2/385
See application file for complete search history.

(56) References Cited

U.S. PATENT DOCUMENTS 5,966,231 A * 10/1999 Bush et al. ..... 359/204.1
2008/0068677 A1* 3/2008 Sakamoto et al. ..... 358/480
2009/0296763 A1* 12/2009 Inukai ..... 372/38.02
2013/0286143 A1 10/2013 Nakahata et al. ..... 347/224

FOREIGN PATENT DOCUMENTS

JP 11078110 A * 3/1999 ..... B41J 2/44
JP 2008-089695 4/2008

* cited by examiner

*Primary Examiner* — Sarah Al Hashimi
(74) *Attorney, Agent, or Firm* — Fitzpatrick, Cella, Harper & Scinto

(57) ABSTRACT

An image forming apparatus according to one aspect controls a light source such that first and second laser beams emitted from first and second light emitting elements respectively are incident on a BD sensor successively, and measures the time interval between two BD signals, output from the BD sensor, that correspond to the first and second laser beams. When performing the measurement, the image forming apparatus controls the light powers of the first and second light beams so as to be light powers determined in advance using APC. According to this, measurement errors when measuring the interval between the light beams emitted from the two light emitting elements are suppressed, and correction accuracy for the image writing start positions for the multiple light emitting elements is improved.

13 Claims, 13 Drawing Sheets

| TARGET LIGHT POWER VALUE [%] | PULSE INTERVAL REFERENCE VALUE | $LD_1$ EMISSION TIMING | $LD_N$ EMISSION TIMING |
|---|---|---|---|
| 100 | $C_{ref_100}$ | $C_{1_100}$ | $C_{N_100}$ |
| 90 | $C_{ref_90}$ | $C_{1_90}$ | $C_{N_90}$ |
| 80 | $C_{ref_80}$ | $C_{1_80}$ | $C_{N_80}$ |
| 70 | $C_{ref_70}$ | $C_{1_70}$ | $C_{N_70}$ |
| 60 | $C_{ref_60}$ | $C_{1_60}$ | $C_{N_60}$ |
| 50 | $C_{ref_50}$ | $C_{1_50}$ | $C_{N_50}$ |
| 40 | $C_{ref_40}$ | $C_{1_40}$ | $C_{N_40}$ |
| 30 | $C_{ref_30}$ | $C_{1_30}$ | $C_{N_30}$ |
| 20 | $C_{ref_20}$ | $C_{1_20}$ | $C_{N_20}$ |
| 10 | $C_{ref_10}$ | $C_{1_10}$ | $C_{N_10}$ |

IMAGE FORMING APPARATUS

BACKGROUND OF THE INVENTION

1. Field of the Invention

The present invention relates to an electrophotographic image forming apparatus.

2. Description of the Related Art

Image forming apparatuses are known which form electrostatic latent images on a photosensitive member by deflecting a light beam emitted from a light source using a rotating polygonal mirror and scanning the photosensitive member using the deflected light beam. This kind of image forming apparatus includes an optical sensor for detecting the light beam deflected by the rotating polygonal mirror (beam detection (BD) sensor), and the optical sensor generates a synchronization signal upon detecting the light beam. By causing the light beam to be emitted from the light source at a timing that is determined using the synchronization signal generated by the optical sensor as a reference, the image forming apparatus keeps constant the writing start position for the electrostatic latent image (image) in the direction in which the light beam scans the photosensitive member (scanning direction).

Also, image forming apparatuses are known which include multiple light emitting elements as light sources for emitting light beams that each scan different lines on the photosensitive member in parallel in order to realize a higher image formation speed and higher resolution images. With this kind of image forming apparatus, a higher image formation speed is realized by scanning multiple lines using multiple light beams at the same time, and higher resolution images are realized by adjusting the interval between the lines in the sub-scanning direction.

FIG. 7A shows an example of a light source included in this kind of image forming apparatus, and in this light source, multiple light emitting elements (LD1 to LDN) are arranged in a row on a plane including an X axis and a Y axis (XY plane). Note that the X axis direction corresponds to the main scanning direction, and the Y axis direction corresponds to the rotation direction of the photosensitive member (sub-scanning direction). With this kind of image forming apparatus, the interval between the light emitting elements in the Y axis direction is adjusted by rotating the light source in the direction of the arrow on the XY plane in the assembly step at the factory, as shown in FIG. 7A. According to this, the interval in the sub-scanning direction of the scanning lines on the photosensitive member (exposure position interval), which are created by the light beams emitted from the light emitting elements, can be adjusted such that it corresponds to a predetermined resolution.

When the light source is rotated in the direction of the arrows shown in FIG. 7A, the interval between the light emitting elements in the Y axis direction changes, and the interval between the light emitting elements in the X direction changes as well. According to this, the light beams emitted from the light emitting elements each form an image on the photosensitive member at different positions S1 to SN in the main scanning direction, as shown in FIG. 7B. Because of this, with an image forming apparatus including a light source such as that shown in FIG. 7A, the writing start positions in the main scanning direction for the electrostatic latent images formed by the light beams emitted from the light emitting elements need to coincide with each other. For this reason, the image forming apparatus causes a light beam to be emitted from a specific light emitting element, an optical sensor detects the light beam and generates a synchronization signal, and the image forming apparatus uses the synchronization signal as a reference to determine the light beam emission timing for each light emitting element such that the writing start positions for the electrostatic latent images coincide with each other. Furthermore, the image forming apparatus causes the light beams to be emitted from the light emitting elements at emission timings determined for respective light emitting elements.

In the above-mentioned assembly step, the light source rotation angle by which the resolution of the image is adjusted to a predetermined resolution varies depending on the installation state of the light source in the image forming apparatus and optical characteristics of optical members such as lenses and mirrors. For this reason, the adjustment amount for the light source rotation angle sometimes varies for each image forming apparatus. In other words, the interval between the light emitting elements in the X axis direction in the light source after rotation adjustment is not always the same for different image forming apparatuses. Here, if the light beam emission timing for each light emitting element, which is obtained by using as a reference the synchronization signals generated by the optical sensor, is set to the same timing for all image forming apparatuses, there is a possibility that a shift in the writing start positions in the main scanning direction for the electrostatic latent images will occur between light emitting elements.

Japanese Patent Laid-Open No. 2008-89695 discloses a technique for suppressing shifts in the writing start positions in the main scanning direction for the electrostatic latent image that are generated due to light source attachment errors in the assembly step as described above. The image forming apparatus disclosed in this patent literature uses an optical sensor (BD sensor) to detect light beams emitted from a first light emitting element and a second light emitting element and generates multiple horizontal synchronization signals. Furthermore, the image forming apparatus sets a light beam emission timing for the second light emitting element relative to the light beam emission timing for the first light emitting element based on the difference in the generation times of the generated horizontal synchronization signals. This compensates for the light source attachment error in the assembly step and suppresses shifts in the writing start positions for the electrostatic latent images between the light emitting elements.

However, the following problems are present in the method for measuring the detection time interval of light beams (i.e., beam interval) by the BD sensor as described above. Generally, the response speed of the BD sensor when a light beam is incident on the BD sensor changes according to the incident light power. For this reason, there is a possibility that a measurement error will occur due to a change in the measurement result of the time interval (beam interval) between pulses (BD signals) generated by the BD sensor changing when the incident light power on the BD sensor changes.

Here, FIG. 8 is a diagram showing an example in which the time interval between pulses generated by the BD sensor changes in the case where the light power of a light beam that is incident on the BD sensor changes. In FIG. 8, the time interval between the pulses generated by the BD sensor in the case where light beams emitted by the light emitting elements 1 and N ($LD_1$ and $LD_N$) are incident on the BD sensor at a constant light power 801 is measured as a time interval 811.

As shown in FIG. 8, when the light power of the light beam that is emitted by the light emitting element N ($LD_N$) and is incident on the BD sensor changes from light power 801 to light power 802, the measurement result of the time interval between the pulses generated by the BD sensor changes from the time interval 811 to a time interval 812. This is because the rising rates and the falling rates of the pulses generated by the BD sensor (i.e., the BD sensor response speed) depend on the light power of the light beam that is incident on the BD sensor. This kind of change in the light power incident on the BD sensor can occur due to a light power adjustment operation such as a density adjustment operation in the image forming apparatus, for example. As shown in FIG. 8, when the light power of a light beam that is incident on the BD sensor changes, an error occurs in the measurement result of the time interval between the pulses generated by the BD sensor, and as a result, it is no longer possible to appropriately control the laser emission timings of the light emitting elements.

SUMMARY OF THE INVENTION

The present invention has been made in view of the above-mentioned problems. The present invention in one aspect provides a technique of, in an image forming apparatus including multiple light emitting elements, suppressing measurement errors when measuring an interval between light beams emitted from two light emitting elements, and improving correction accuracy for the image writing start positions of the light emitting elements.

According to one aspect of the present invention, there is provided an image forming apparatus in which a plurality of light beams are deflected such that the plurality of light beams scan a photosensitive member, the image forming apparatus comprising: a light source including a plurality of light emitting elements that each emit a light beam; a light power control unit configured to control a light power of light beam that are to be emitted from each of the plurality of light emitting elements; a detection unit, that is provided on a scanning path of the plurality of light beams have been deflected, configured to output a detection signal indicating that a light beam has been detected due to the light beam being incident on the detection unit; a measuring unit configured to control the light source such that first and second light beams emitted from first and second light emitting elements among the plurality of light emitting elements are sequentially incident on the detection unit, and to measure a time interval between detection signals that correspond to the first and second light beams and are output from the detection unit; and a timing control unit configured to control relative emission timings of light beams emitted from the plurality of light emitting elements, according to the time interval measured by the measuring unit, wherein the light power control unit is configured to control light powers of the first and second light beams that are to be incident on the detection unit, so as to be a predetermined light power.

According to the present invention, it is possible to provide a technique of, in an image forming apparatus including multiple light emitting elements, suppressing measurement errors when measuring an interval between light beams emitted from two light emitting elements, and improving correction accuracy for the image writing start positions of the light emitting elements.

Further features of the present invention will become apparent from the following description of exemplary embodiments with reference to the attached drawings.

DESCRIPTION OF THE EMBODIMENTS

Hereinafter, embodiments of the present invention will be described in detail with reference to the accompanying drawings. It should be noted that the following embodiments are not intended to limit the scope of the appended claims, and that not all the combinations of features described in the embodiments are necessarily essential to the solving means of the present invention.

A first and second embodiment will be described below taking the example of an electrophotographic image forming apparatus that forms multi-color (full-color) images using multiple colors of toner (developing material). Note that the embodiments can be applied to an image forming apparatus that forms monochrome images using only a single color of toner (e.g., black).

First Embodiment

Hardware Configuration of Image Forming Apparatus

Figure 1:
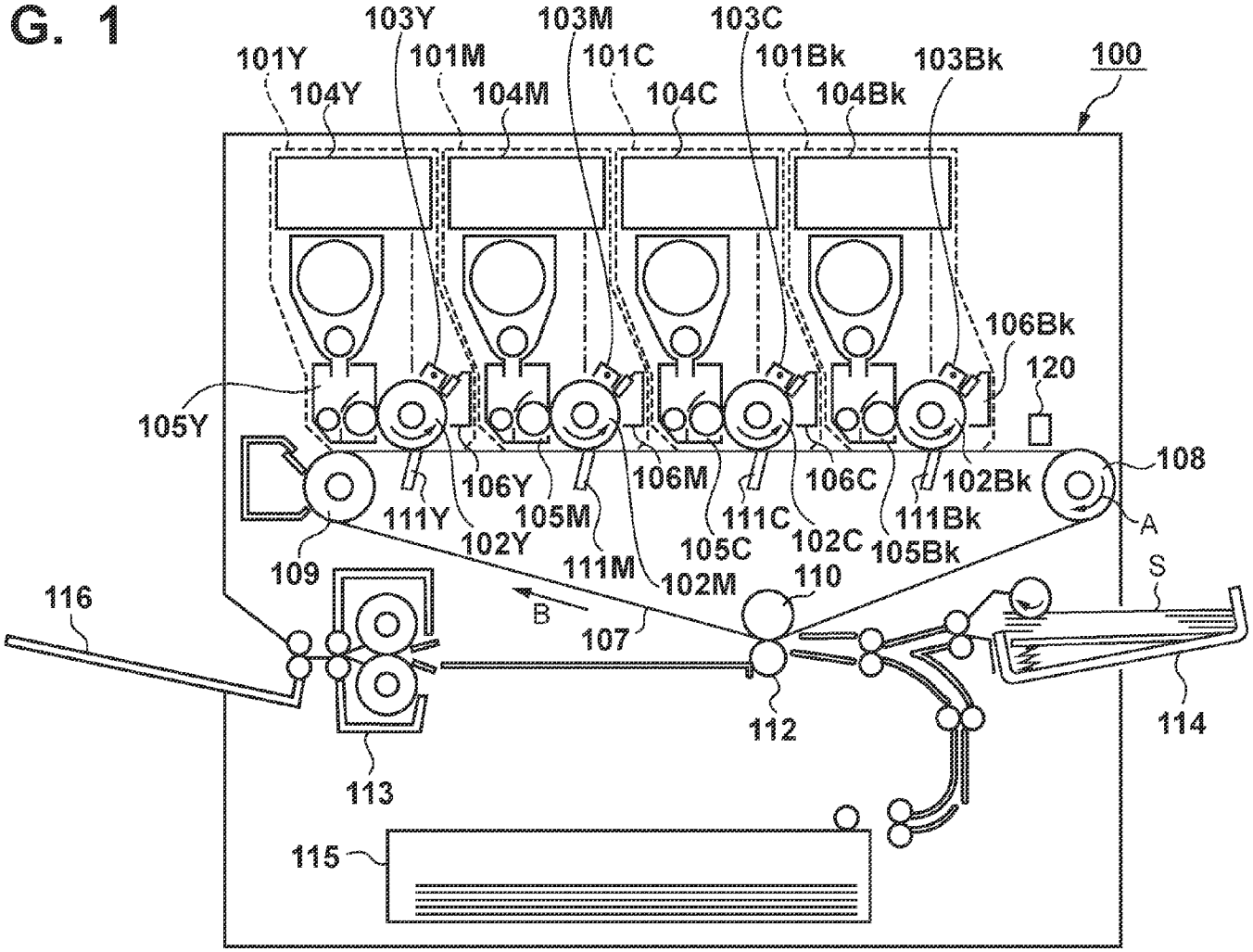
FIG. 1 is a schematic cross-section diagram of an image forming apparatus according to a first embodiment.

First, a configuration of an image forming apparatus 100 according to the present embodiment will be described with reference to FIG. 1. The image forming apparatus 100 includes four image forming units 101Y, 101M, 101C, and 101Bk that form images (toner images) using yellow (Y), magenta (M), cyan (C), and black (Bk) toner respectively.

The image forming units 101Y, 101M, 101C, and 101Bk include photosensitive drums (photosensitive members) 102Y, 102M, 102C, and 102Bk respectively. Charging units 103Y, 103M, 103C, and 103Bk, optical scanning apparatuses 104Y, 104M, 104C, and 104Bk, and developing units 105Y, 105M, 105C, and 105Bk are arranged in the vicinity of the photosensitive drums 102Y, 102M, 102C, and 102Bk respectively. Drum cleaning units 106Y, 106M, 106C, and 106Bk are furthermore arranged in the vicinity of the photosensitive drums 102Y, 102M, 102C, and 102Bk respectively.

An intermediate transfer belt (intermediate transfer member) 107 in the shape of an endless belt is arranged below the photosensitive drums 102Y, 102M, 102C, and 102Bk. The intermediate transfer belt 107 is wound around a driving roller 108 and driven rollers 109 and 110. When image formation is in progress, the peripheral surface of the intermediate transfer belt 107 moves in the direction of arrow B in accordance with the rotation of the driving roller 108 in the direction of arrow A shown in FIG. 1. Primary transfer units 111Y, 111M, 111C, and 111Bk are arranged at positions opposing the photosensitive drums 102Y, 102M, 102C, and 102Bk via the intermediate transfer belt 107. The image forming apparatus 100 further includes a secondary transfer unit 112 for transferring a toner image formed on the intermediate transfer belt 107 onto a recording medium S, and a fixing unit 113 for fixing, to the recording medium S, toner image that has been transferred onto the recording medium S.

Image forming processes from a charging process to a developing process in the image forming apparatus 100 having the above-described configuration will be described next. Note that the image forming processes executed by the respective image forming units 101Y, 101M, 101C, and 101Bk are similar. For this reason, a description will be given below using the image forming process in the image forming unit 101Y as an example, and the image forming processes in the image forming units 101M, 101C, and 101Bk will not be described.

First, the charging unit 103Y in the image forming unit 101Y charges the surface of the photosensitive drum 102Y (the surface thereof) that is being driven so as to rotate. The optical scanning apparatus 104Y emits multiple laser beams (light beams), scans the charged surface of the photosensitive drum 102Y (the surface thereof) using the laser beams, and thereby exposes the surface of the photosensitive drum 102Y (the surface thereof) by using the laser beams. According to this, an electrostatic latent image is formed on the rotating photosensitive drum 102Y. After being formed on the photosensitive drum 102Y, the electrostatic latent image is developed by the developing unit 105Y using Y toner. As a result, a Y toner image is formed on the photosensitive drum 102Y. Also, in the image forming units 101M, 101C, and 101Bk, M, C, and Bk toner images are formed on the photosensitive drums 102M, 102C, and 102Bk respectively with processes similar to that of the image forming unit 101Y.

The image forming processes from a transfer process onward will be described below. In the transfer process, first, the primary transfer units 111Y, 111M, 111C, and 111Bk each apply a transfer bias to the intermediate transfer belt 107. According to this, toner images of four colors (Y, M, C, and Bk) that have been formed on the photosensitive drums 102Y, 102M, 102C, and 102Bk are transferred in an overlaid manner onto the intermediate transfer belt 107.

After being formed on the intermediate transfer belt 107 in an overlaid manner, the toner image composed of four colors of toner is conveyed to a secondary nip portion between the secondary transfer unit 112 and the intermediate transfer belt 107 in accordance with the movement of the peripheral surface of the intermediate transfer belt 107. The recording medium S is conveyed from a manual feeding cassette 114 or a paper feeding cassette 115 to the secondary transfer nip portion in synchronization with the timing at which the toner image formed on the intermediate transfer belt 107 is conveyed to the secondary transfer nip portion. In the secondary transfer nip portion, the toner image formed on the intermediate transfer belt 107 is transferred onto the recording medium S by means of a transfer bias applied by the secondary transfer unit 112 (secondary transfer).

After being formed on the recording medium S, the toner image undergoes heating in the fixing unit 113 and is thereby fixed to the recording medium S. After a multi-color (full color) image is formed in this way on the recording medium S, the recording medium S is discharged to a discharge unit 116.

Note that after the transfer of the toner image onto the intermediate transfer belt 107 ends, toner remaining on the photosensitive drums 102Y, 102M, 102C, and 102Bk is removed by the drum cleaning units 106Y, 106M, 106C, and 106Bk respectively. When the series of image forming processes ends in this way, image forming processes for the next recording medium S are subsequently started.

The image forming apparatus 100 performs a density adjustment operation to keep constant the density characteristic of the image to be formed. A density detection sensor 120 for detecting the density of a toner image formed on the intermediate transfer belt 107 is provided at a position opposing the intermediate transfer belt 107. The image forming apparatus 100 performs a predetermined density adjustment operation using the density detection sensor 120 to detect the densities of the toner images of respective colors formed on the intermediate transfer belt 107. The optical scanning apparatuses 104Y, 104M, 104C, and 104Bk can adjust the density characteristic of the image to be formed, by adjusting the light power of the light beams emitted from the light source such that the densities of the toner images of respective colors detected by the density detection sensor 120 become a predetermined value. Note that the adjustment of the light power of the light beam for this kind of density characteristic adjustment can be realized by adjusting a light power target value (target light power) used in a later-described automatic power control (APC).

Hardware Configuration of Optical Scanning Apparatus

The configuration of the optical scanning apparatuses 104Y, 104M, 104C, and 104Bk will be described next with reference to FIGS. 2A, 3A to 3C, and 7A to 7C. Note that since the configurations of the image forming units 101Y, 101M, 101C, and 101Bk are the same, there are cases below where reference numerals are used without the suffixes Y, M, C, and Bk. For example, "photosensitive drum 102" represents the photosensitive drums 102Y, 102M, 102C, and 102Bk, and "optical scanning apparatus 104" represents the optical scanning apparatuses 104Y, 104M, 104C, and 104Bk.

Figure 2A:
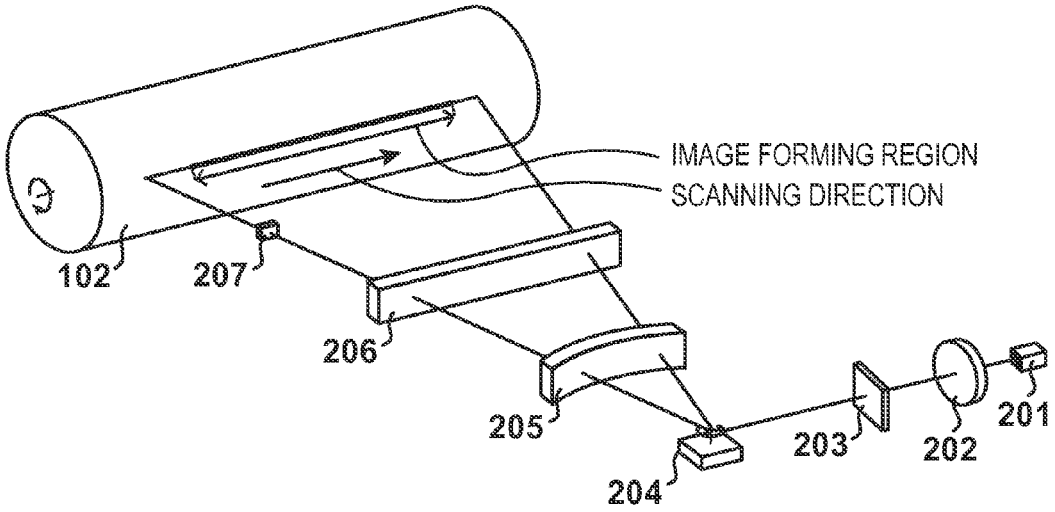
FIG. 2A is a diagram showing a configuration of an optical scanning apparatus 104 that scans the surface of a photosensitive drum using light beams, according to the first embodiment.

FIG. 2A is a diagram showing the configuration of the optical scanning apparatus 104. The optical scanning apparatus 104 includes a laser light source 201 and various optical members 202 to 206 (a collimator lens 202, a cylindrical lens 203, a polygon mirror (rotating polygonal mirror) 204, and fθ lenses 205 and 206). The laser light source (referred to hereinafter as simply "light source") 201 generates and outputs (emits) a laser beam (light beam) with a light power that corresponds to the driving current. The collimator lens 202 shapes the laser beam emitted from the light source 201 into collimated light. After the laser beam passes through the collimator lens 202, the cylindrical lens 203 condenses the laser beam in the sub-scanning direction (direction corresponding to the rotation direction of the photosensitive drum 102).

After passing through the cylindrical lens 203, the laser beam is incident on one of the reflecting surfaces of the polygon mirror 204. The polygon mirror 204 reflects the incident laser beam with the reflecting surfaces while rotating such that the incident laser beam is deflected at continuous angles. The laser beam deflected by the polygon mirror 204 is sequentially incident on the fθ lenses 205 and 206. Due to passing through the fθ lenses (scanning lenses) 205 and 206, the laser beam becomes a scanning beam that scans the photosensitive drum 102 at a constant speed.

On the scanning path of the laser beam deflected by the polygon mirror 204, the optical scanning apparatus 104 further includes a beam detection (BD) sensor 207 as an optical sensor for detecting laser beams. That is to say, the BD sensor 207 is provided on the scanning path for when multiple laser beams (light beams) scan the photosensitive drum 102. When a laser beam deflected by the polygon mirror 204 is incident on the BD sensor 207, the BD sensor 207 outputs, as a synchronization signal (horizontal synchronization signal), a detection signal (BD signal) indicating that the laser beam has been detected. As will be described later, the synchronization signals output from the BD sensor 207 are used as a reference to control the turning-on timings of the light emitting elements ($LD_1$ to $LD_N$) based on the image data.

Next, the configuration of the light source 201 and the scanning positions of the laser beams emitted from the light source 201 on the photosensitive drum 102 and the BD sensor 207 will be described with reference to FIGS. 3A to 3C.

Figure 3A:
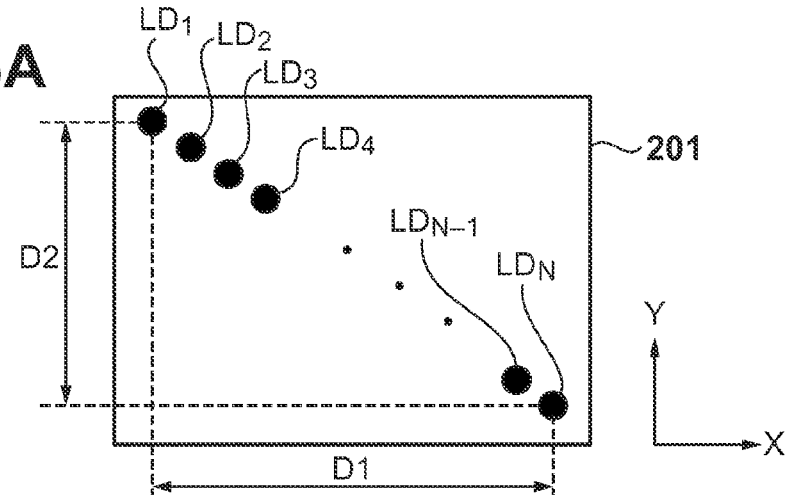
FIGS. 3A to 3C are diagrams showing schematic configurations of a light source and a BD sensor as well as scanning positions for laser beams emitted from the light source on a photosensitive drum and the BD sensor according to the first embodiment.
Figure 3B:
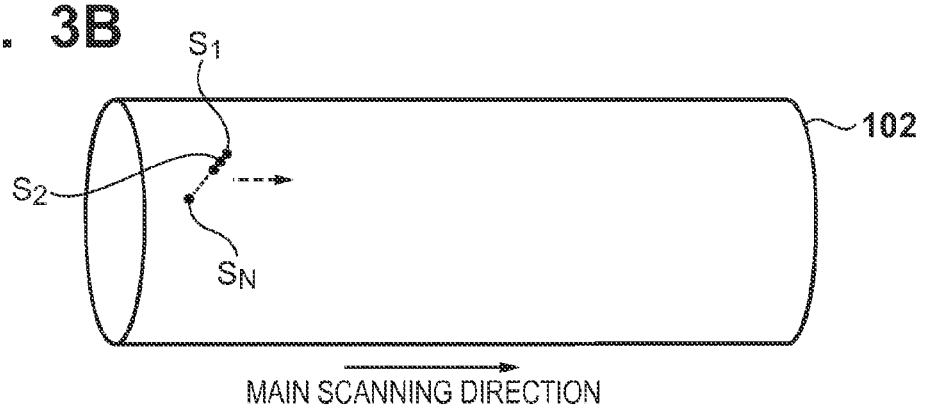

First, FIG. 3A is an enlarged view of the light source 201, and FIG. 3B is a diagram showing the scanning positions of the laser beams emitted from the light source 201 on the photosensitive drum 102. The light source 201 includes N light emitting elements ($LD_1$ to $LD_N$) that each emit (output) a laser beam. The n-th (n being an integer from 1 to N) light emitting element n ($LD_n$) of the light source 201 emits a laser beam $L_n$. The X axis direction in FIG. 3A is the direction that corresponds to the direction in which the laser beams deflected by the polygon mirror 204 scan the photosensitive drum 102 (the main scanning direction). Also, the Y axis direction is the direction orthogonal to the main scanning direction, which is the direction that corresponds to the rotation direction of the photosensitive drum 102 (sub-scanning direction).

As shown in FIG. 3B, the laser beams $L_1$ to $L_N$ that have been emitted from the light emitting elements 1 to N form spot-shaped images at positions $S_1$ to $S_N$ that are different in the sub-scanning direction on the photosensitive drum 102. According to this, the laser beams $L_1$ to $L_N$ scan main scanning lines that are adjacent in the sub-scanning direction in parallel on the photosensitive drum 102. Also, due to the light emitting elements 1 to N being arranged in an array as shown in FIG. 3A in the light source 201, the laser beams $L_1$ to $L_N$ form images at positions on the photosensitive drum 102 that are different in the main scanning direction as well, as shown in FIG. 3B. Note that in FIG. 3A, the N light emitting elements ($LD_1$ to $LD_N$) are arranged in one straight line (one-dimensionally) in the light source 201, but they may be arranged two-dimensionally.

Reference numeral D1 in FIG. 3A represents the interval (distance) between the light emitting element 1 ($LD_1$) and the light emitting element N ($LD_N$) in the X axis direction. In the present embodiment, the light emitting elements 1 and N are light emitting elements arranged at the two ends of the light emitting elements that are arranged in a straight line in the light source 201. The light emitting element N is arranged the farthest from the light emitting element 1 in the X axis direction. For this reason, as shown in FIG. 3B, among the laser beams, the image forming position $S_N$ of the laser beam $L_N$ is at the position that is the farthest from the image forming position $S_1$ of the laser beam $L_1$ in the main scanning direction on the photosensitive drum 102.

Reference numeral D2 in FIG. 3A represents the interval (distance) between the light emitting element 1 ($LD_1$) and the light emitting element N ($LD_N$) in the Y axis direction. Among the light emitting elements, the light emitting element N is the farthest from the light emitting element 1 in the Y axis direction. For this reason, as shown in FIG. 3B, among the laser beams, the image forming position $S_N$ of the laser beam $L_N$ is at the position that is the farthest from the image forming position $S_1$ of the laser beam $L_1$ in the sub-scanning direction on the photosensitive drum 102.

Figure 7A:
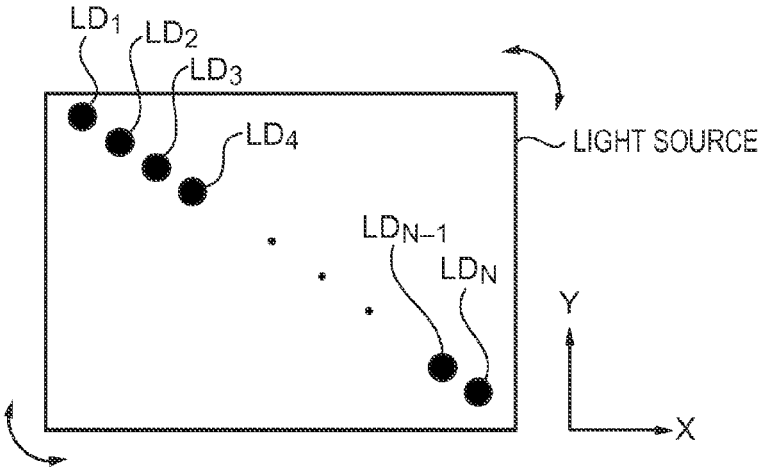
FIGS. 7A to 7C are diagrams showing an example of a light source configuration and a modified example of scanning positions for laser beams emitted from the light source on a photosensitive drum.
Figure 7B:
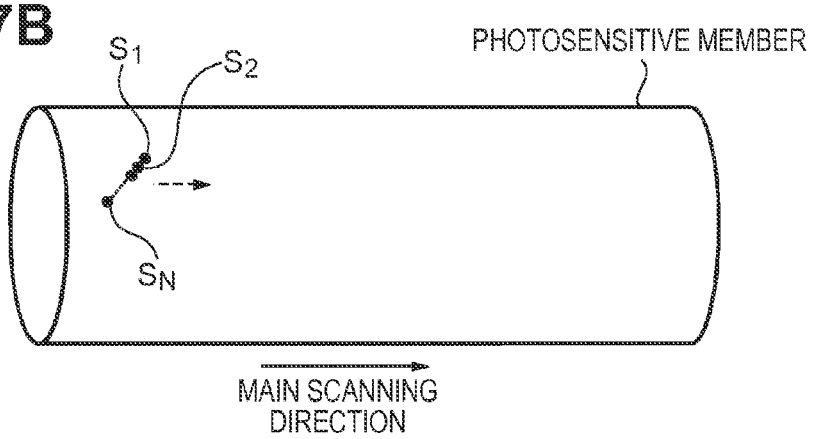

A light emitting element interval Ps=D2/N−1 in the Y axis direction (sub-scanning direction) is an interval that corresponds to the resolution of the image that is to be formed by the image forming apparatus 100. Ps is a value that is set by performing rotation adjustment on the light source 201 (as shown in FIG. 7A) in the assembly step of the image forming apparatus 100 such that the interval between adjacent image forming positions $S_n$ in the sub-scanning direction on the photosensitive drum 102 becomes an interval that corresponds to a predetermined resolution. Also, a light emitting element interval Pm=D1/N−1 in the X axis direction (main scanning direction) is a value that is determined uniquely depending on the light emitting element interval Ps in the Y axis direction.

The timings according to which the laser beams are to be emitted from the light emitting elements ($LD_n$), and which are determined using the timing of the generation and output of the synchronization signals (BD signals) by the BD sensor 207 as a reference, are set for each light emitting element using a predetermined jig in the assembly step. The set timings for the respective light emitting elements are stored in a memory 406 (FIG. 4) as initial values at the time of factory shipping of the image forming apparatus 100. The initial values for the timings according to which the laser beams are to be emitted from the light emitting elements ($LD_n$) set in this way have values corresponding to Pm.

Figure 3C:
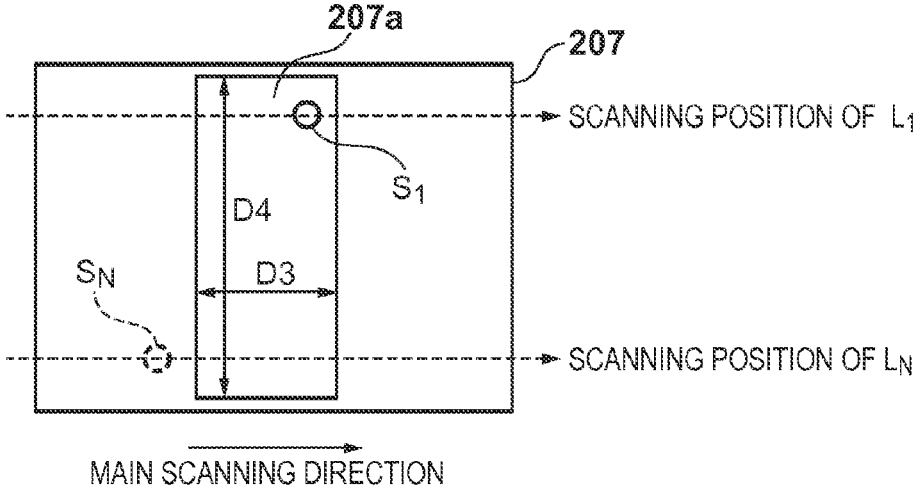

Next, FIG. 3C is a diagram showing a schematic configuration of the BD sensor 207 and the scanning positions of the laser beams emitted from the light source 201 on the BD sensor 207. The BD sensor 207 includes a light-receiving surface 207*a* on which photoelectric conversion elements are arranged planarly. When a laser beam is incident on the light-receiving surface 207*a*, the BD sensor 207 generates and outputs a BD signal (synchronization signal) indicating that a laser beam has been detected. The optical scanning apparatus 104 of the present embodiment causes laser beams $L_1$ and $L_N$ that have been emitted from the light emitting elements 1 and N ($LD_1$ and $LD_N$) to be incident on the BD sensor 207 in order, and thus causes (two) BD signals corresponding to the laser beams to be output in order from the BD sensor 207. Note that in the present embodiment, the light emitting elements 1 and N ($LD_1$ and $LD_N$) are examples of a first light emitting element and a second light emitting element respectively, and the laser beams $L_1$ and $L_N$ are examples of a first light beam and a second light beam respectively.

In FIG. 3C, the width in the main scanning direction and the width in the direction corresponding to the sub-scanning direction of the light-receiving surface 207*a* are indicated as D3 and D4 respectively. In the present embodiment, the laser beams $L_1$ and $L_N$ that are emitted from the light emitting elements 1 and N ($LD_1$ and $LD_N$) respectively scan the light-receiving surface 207*a* of the BD sensor 207 as shown in FIG. 3C. For this reason, the width D4 is set to a value that satisfies the condition $D4>D2\times\alpha$, such that both of the laser beams $L_1$ and $L_N$ can be incident on the light-receiving surface 207*a*. Note that a is the rate of fluctuation in the sub-scanning direction with respect to the interval between the laser beams $L_1$ and $L_N$ that have passed through the various lenses. Also, the width D3 is set to a value that satisfies the condition $D3<D1\times\beta$, such that the laser beams $L_1$ and $L_N$ are not incident on the light-receiving surface 207*a* at the same time even if the light emitting elements 1 and N ($LD_1$ and $LD_N$) are turned on at the same time. Note that β is the rate of fluctuation in the main scanning direction with respect to the interval between the laser beams $L_1$ and $L_N$ that have passed through the various lenses.

Control Configuration of Image Forming Apparatus

Figure 4:
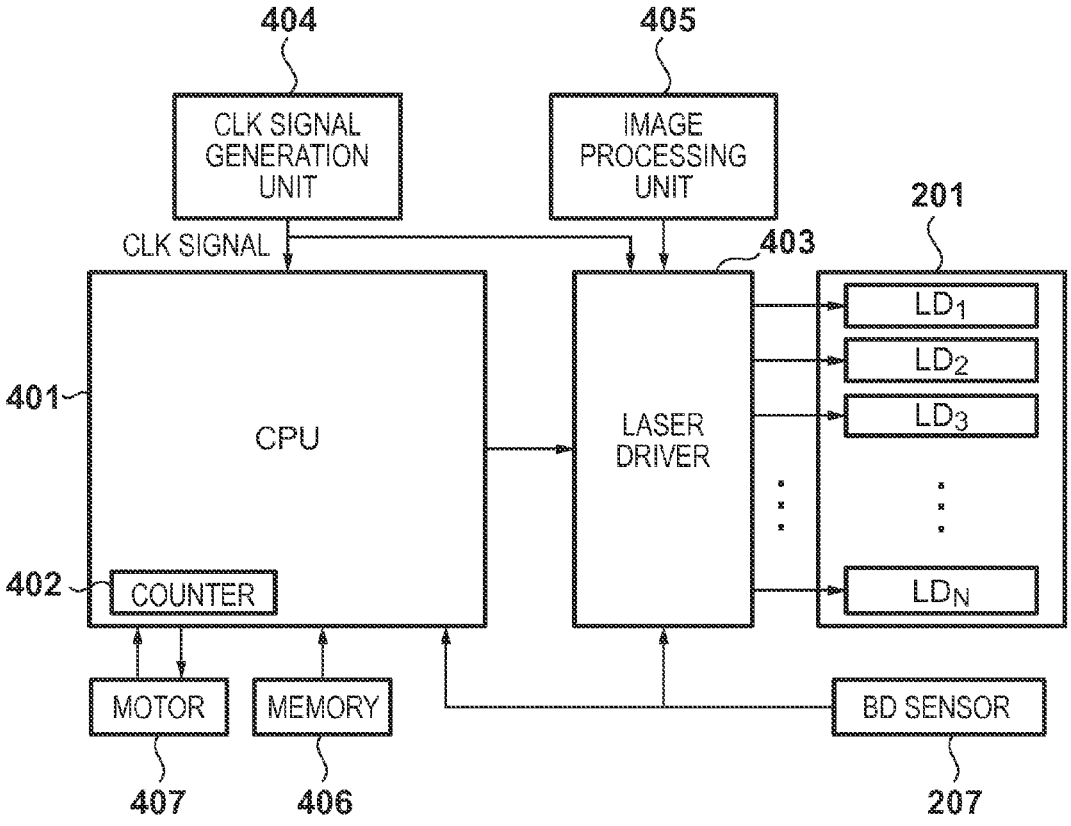
FIG. 4 is a block diagram showing a control configuration of the image forming apparatus according to the first embodiment.

FIG. 4 is a block diagram showing the control configuration of the image forming apparatus 100 according to the present embodiment. The image forming apparatus 100 includes, as the control configuration, a CPU 401, a laser driver 403, a clock (CLK) signal generation unit 404, an image processing unit 405, the memory 406, and a motor 407. Note that in the present embodiment, the laser driver 403, the light source 201, and the BD sensor 207 shown in FIG. 4 are included in the optical scanning apparatus 104.

A counter 402 is included in the CPU 401, and the CPU 401 performs overall control of the image forming apparatus 100 by executing a control program stored in the memory 406. The CLK signal generation unit 404 generates clock signals (CLK signals) at a predetermined frequency and outputs the generated clock signals to the CPU 401 and the laser driver 403. The CPU 401 uses the counter 402 to count the CLK signals input from the CLK signal generation unit 404 and outputs control signals to the laser driver 403 and the motor 407 in synchronization with the CLK signals.

The motor 407 is a polygon motor that drives the polygon mirror 204 so as to rotate. The motor 407 includes a speed sensor (not shown) that employs a frequency generator (FG) scheme for generating frequency signals that are proportionate to the rotation speed. The motor 407 uses the speed sensor to generate FG signals at a frequency corresponding to the rotation speed of the polygon mirror 204 and outputs the FG signals to the CPU 401. The CPU 401 measures the generation period of the FG signals input from the motor 407 based on the count value of the counter 402. When the measured generation period of the FG signals reaches a predetermined period, the CPU 401 determines that the rotation speed of the polygon mirror 204 has reached a predetermined speed.

The BD sensor 207 generates the BD signals in response to the detection of the laser beams and outputs the generated BD signals to the CPU 401 and the laser driver 403. The CPU 401 generates control signals for controlling the emission timings of the laser beams from the light emitting elements 1 to N ($LD_1$ to $LD_N$) based on the BD signals input from the BD sensor 207, and transmits the generated control signals to the laser driver 403. A driving current based on image data for image formation input from the image processing unit 405 (i.e., a driving current modulated according to the image data) is supplied by the laser driver 403 to each of the light emitting elements at a timing based on the control signals transmitted from the CPU 401. According to this, the laser driver 403 causes laser beams having light powers that correspond to the driving currents to be emitted from the respective light emitting elements.

Also, the CPU 401 designates a light power target value for the light emitting elements 1 to N ($LD_1$ to $LD_N$) with respect to the laser driver 403 and instructs with respect to the laser driver 403 to execute APC for the light emitting elements at a timing based on the input BD signals. Here, APC is an operation in which the laser driver 403 controls the light power of the laser beam emitted from each of the light emitting elements 1 to N so as to be light power that is equal to the light power target value. The laser driver 403 executes APC by adjusting the magnitude of the driving current supplied to each of the light emitting elements such that the light power of the light emitting element detected by a PD (photo diode) installed in the same package as the light emitting elements 1 to N matches the light power target value. In this way, the laser driver 403 is an example of a light power control unit configured to control the light powers of the laser beams (light beams) emitted from the respective light emitting elements.

Note that the laser driver 403 executes APC in the period designated by the CPU 401. Also, in the present embodiment, the light power target value that is to be used in the APC is set by a density adjustment operation that is based on the detection of the toner image formed on the intermediate transfer belt 107.

Optical Scanning Performed by Optical Scanning Apparatus Including Multiple Light Emitting Elements As described above, in an image forming apparatus including multiple light emitting elements such as that in FIG. 7A, the laser beams $L_1$ to $L_N$ that are emitted from the light emitting elements form images at positions $S_1$ to $S_N$ that are different in the main scanning direction on the photosensitive drum 102. Accordingly, the writing start positions for the electrostatic latent images (images) in the main scanning direction need to coincide with each other for the light emitting elements. In this kind of image forming apparatus, for example, one BD signal is generated based on a laser beam emitted from a specific light emitting element, and using this BD signal as a reference, the relative laser emission timings for the light emitting elements are controlled based on fixed setting values that have been set in advance. With this kind of laser emission timing control based on one BD signal, it is possible to make the image writing start positions coincide with each other as long as the relative positional relationship between the image forming positions $S_1$ to $S_N$ is constant during image formation.

Figure 7C:
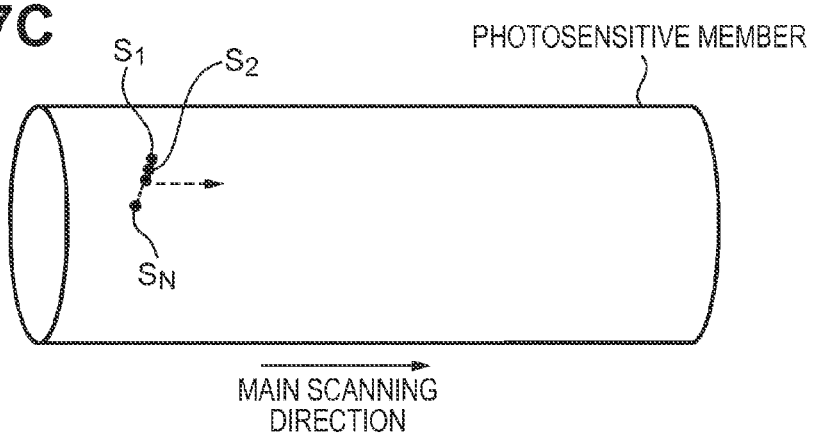

However, when the light emitting elements emit laser beams, the wavelengths of the laser beams output from the light emitting elements change along with an increase in the temperature of the light emitting elements themselves. Also, due to the heat generated by the motor 407 when rotating the polygon mirror 204, the overall temperature of the optical scanning apparatus 104 increases and the optical characteristics (refractive index, etc.) of the scanning lenses 205 and 206 and the like change. This causes the optical paths of the laser beams emitted from the light emitting elements to change. FIG. 7C shows a situation in which the image forming positions $S_1$ to $S_N$ of the laser beams have shifted from the positions shown in FIG. 7B due to the optical paths of the laser beams emitted from the light emitting elements changing. When the relative positional relationship between the image forming positions $S_1$ to $S_N$ changes in this way, the writing start positions in the main scanning direction for the electrostatic latent images that are to be formed by the laser beams cannot be caused to coincide with each other using the laser emission timing control which is based on one BD signal described above.

In view of this, the image forming apparatus 100 (optical scanning apparatus 104) according to the present embodiment generates two BD signals based on the laser beams emitted from two light emitting elements among the light emitting elements ($LD_1$ to $LD_N$), and uses the BD signals for the laser emission timing control. Specifically, the image forming apparatus 100 causes the BD sensor 207 to detect the two laser beams emitted from the light emitting elements 1 and N ($LD_1$ and $LD_N$), thereby causing the BD sensor 207 to generate the two BD signals. Furthermore, the image forming apparatus 100 controls the laser emission timings for the light emitting elements based on the difference in the times at which the BD sensor 207 generates the two BD signals (i.e., the difference in the laser beam detection times).

Figures 8, 9:
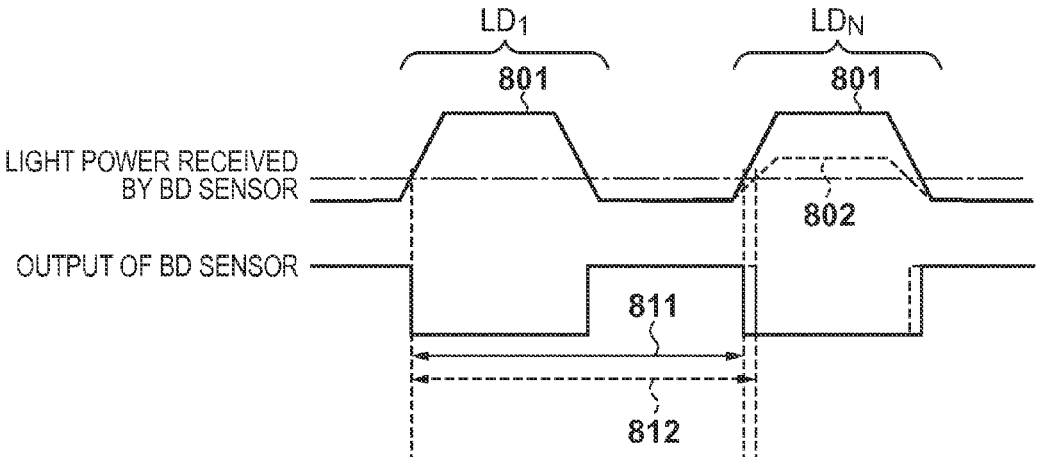
FIG. 8 is a diagram showing an example of a relationship between received light power of the BD sensor and a time interval between BD signals output from the BD sensor.
FIG. 9 is a diagram showing an example of reference values and timing values for beam emission timing control according to the first embodiment.

Here, the response speed of the BD sensor 207 changes according to the light power of the incident laser beam, as shown in FIG. 8. For this reason, when the light power of the laser beam that is incident on the BD sensor 207 changes, an error occurs in the measurement result for the time interval (difference in BD signal generation timings) between the pulses (BD signals) generated by the BD sensor, as described above. As a result, the laser emission timings of the light emitting elements cannot be appropriately controlled.

In order to deal with this kind of problem, the image forming apparatus 100 according to the present embodiment, when performing measurement of the time interval between the two BD signals using the two light emitting elements (first and second light emitting elements), controls the light powers of the two light emitting elements so as to be a predetermined light power, and then executes measurement.

Specifically, the CPU 401 controls the light source 201 such that the first and second laser beams that have been respectively emitted from the first and second light emitting elements are incident on the BD sensor 207 sequentially. Furthermore, the CPU 401 measures the time interval between the two BD signals that are output from the BD sensor 207 and correspond to the first and second laser beams. The CPU 401 (laser driver 403), when performing the measurement, controls the light powers of the first and second light beams so as to be the light powers determined in advance by the APC. According to this, when measuring the time interval between the two BD signals, the light powers of the two light emitting elements that are to be used in the measurement can be made stable and measurement errors such as those described above can be suppressed.

Laser Emission Timing Control Based on Two BD Signals

Next, a more detailed description will be given regarding laser emission timing control based on the two BD signals, for the multiple (N) light emitting elements ($LD_1$ to $LD_N$) according to the present embodiment.

In the present embodiment, when a predetermined period is reached, the CPU 401 measures the time interval between the two BD signals (pulses) generated based on the laser beams emitted from the light emitting elements 1 and N. Note that the time interval between the BD signals corresponds to the time interval in the main scanning direction (beam interval) when the laser beams emitted from the light emitting elements 1 and N scan the surface of the photosensitive drum 102. The beam interval may be measured periodically (e.g., each time 100 pages of images are formed). In the period of performing beam interval measurement (beam interval measurement period), APC is executed with respect to the light emitting elements that are to be used in the measurement (light emitting elements 1 and N in the present embodiment) before the measurement is started to be executed.

Specifically, when the beam interval measurement period is reached, APC for controlling the light powers of the laser beams emitted by the light emitting elements 1 and N so as to be a predetermined light power is performed before the laser beams for beam interval measurement (first and second light beams) are emitted from the light emitting elements 1 and N. The APC is executed by the laser driver 403 under control of the CPU 401. Note that in the present embodiment, the light powers of the laser beams emitted by the light emitting elements 1 and N in the beam interval measurement period are controlled so as to be light powers that are equal to the light power target value set in advance using the above-described density adjustment operation. According to this, even if the light powers of the laser beams emitted by the light emitting elements 1 and N change with time, the light powers can be made stable at constant light powers that are equal to the light power target value, and measurement errors can be suppressed at the time of beam interval measurement.

When the measurement in the beam interval measurement period (referred to below as simply the "measurement period") ends, the CPU 401 controls (corrects) the beam emission timings of the light emitting elements based on the measurement result in a predetermined period (e.g., in the period up to when the next beam interval measurement is performed). Note that in a non-beam-interval-measurement period (referred to below as a "non-measurement period"), which is a period other than a measurement period, in which beam interval measurement is not performed, APC is executed sequentially on the light emitting elements included in the light source 201 for image formation.

Figure 5A:
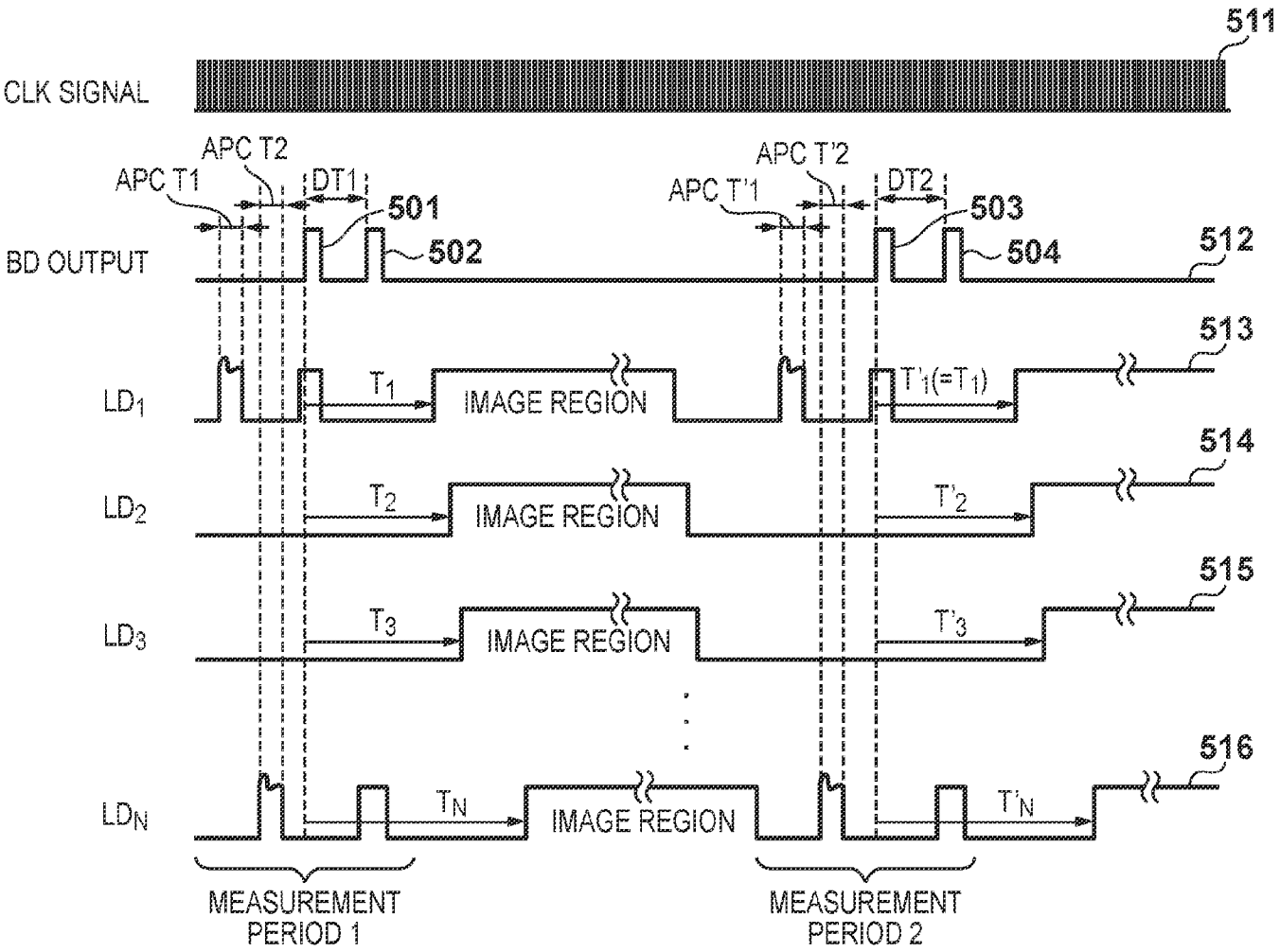
FIG. 5A is a timing chart showing the timing of operations performed by the optical scanning apparatus according to the first embodiment.
Figure 5B:
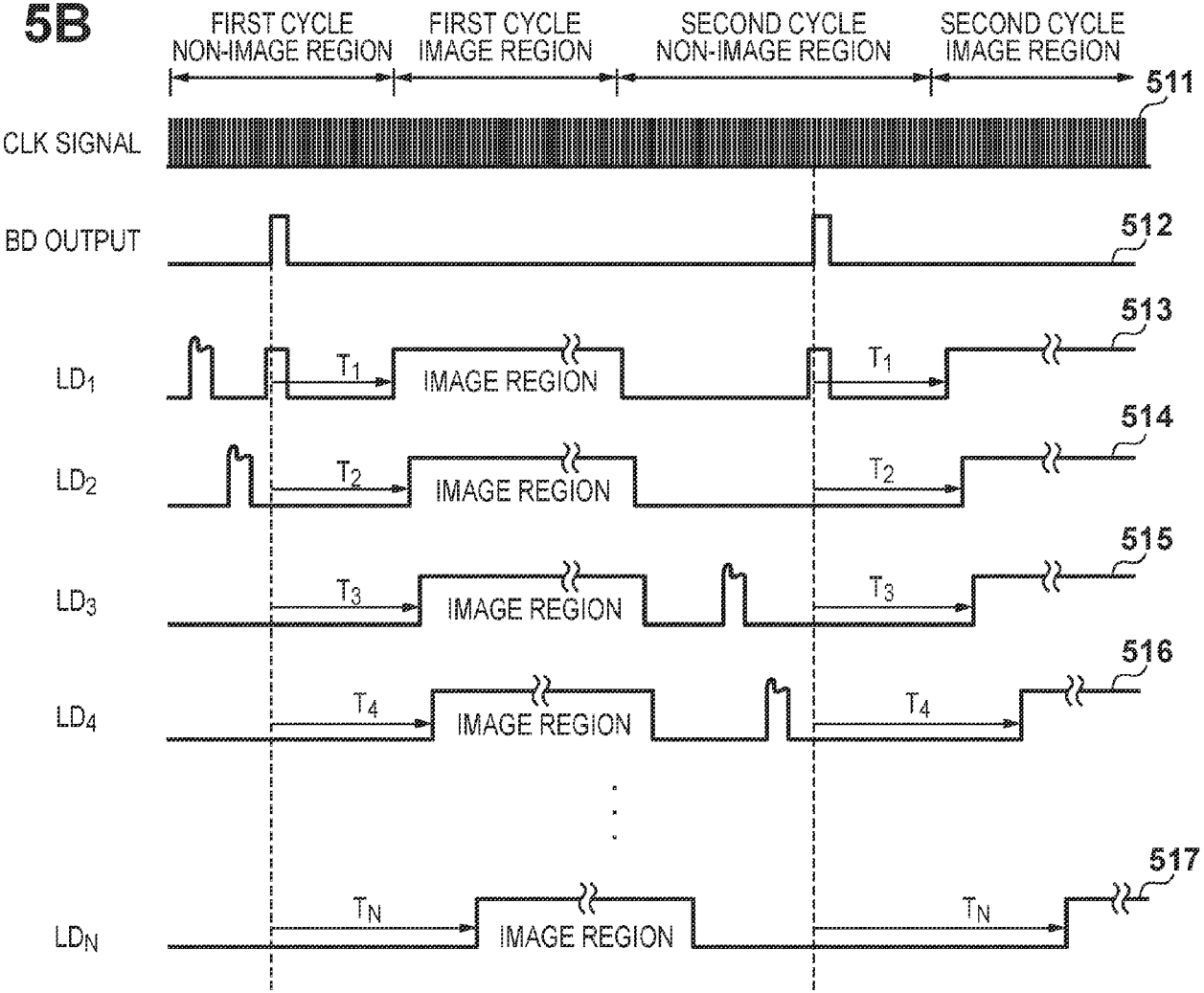
FIG. 5B is a timing chart showing the timing of operations performed by the optical scanning apparatus according to the first embodiment.

FIGS. 5A and 5B are timing charts showing the timing of operations of the optical scanning apparatus 104 according to the present embodiment. These figures show CLK signals 511, output signals 512 of the BD sensor 207, and light powers 513 to 516 of the laser beams emitted by the light emitting elements 1, 2, 3, and N. Also, FIGS. 5A and 5B show laser beam emission timings for the light emitting elements 1 to N and BD signal output timings for the BD sensor 207 in a measurement period and a non-measurement period. Note that the two measurement periods 1 and 2 shown in FIG. 5A each correspond to measurement periods for adjusting the emission timings at which the light emitting elements emit laser beams (light beams) when an electrostatic latent image is to be formed on the surface of the photosensitive drum 102.

In FIG. 5A, when the measurement periods 1 and 2 are reached, the measurement of the beam interval using the light emitting elements 1 and 2 is performed in the measurement periods. In the measurement periods, the CPU 401 controls the laser driver 403 such that the laser beams are emitted at a predetermined interval from the light emitting elements 1 and N that are used for the measurement, and executes one beam interval measurement in one laser beam scanning period.

Specifically, the CPU 401 controls the laser driver 403 to sequentially emit the laser beams (first and second light beams) at the predetermined interval from the light emitting elements 1 and N among the light emitting elements (light emitting elements 1 to N). According to this, in the measurement period 1, BD signals 501 and 502 that correspond to the light emitting elements 1 and 2 respectively are generated by the BD sensor 207 and output to the CPU 401 and the laser driver 403. Also, in the measurement period 2, BD signals 503 and 504 that correspond to the light emitting elements 1 and N respectively are generated by the BD sensor 207 and output to the CPU 401 and the laser driver 403. The CPU 401 measures a time interval (generation time difference) DT1 between the BD signal 501 and the BD signal 502 in the measurement period 1 and measures the time interval DT2 between the BD signal 503 and the BD signal 504 in the measurement period 2, as count values $C_{DT}$ based on the counter 402.

In the measurement period 1, in response to the BD signal 501 being input from the BD sensor 207, the CPU 401 starts the count of the CLK signal 511. Subsequently, in response to the BD signal 502 being input from the BD sensor 207, the CPU 401 ends the count of the CLK signal 511 and generates the count value $C_{DT}$. The count value $C_{DT}$ is a value indicating the time interval DT1 between the BD signal 501 and the BD signal 502, shown in FIG. 5A.

In the present embodiment, before measuring the time interval between the BD signals 501 and 502, the CPU 401 executes APC with respect to the light emitting elements 1 and N and thereby adjusts the light powers of the light emitting elements 1 and N to the pre-set light power target value. As shown in FIG. 5A, the CPU 401 executes APC on the light emitting element 1 at a timing before the laser beam is emitted from the light emitting element 1 for the purpose of detecting the BD signal 501 (APC T1). Also, the CPU 401 executes APC on the light emitting element N at a timing (APC T2) before the laser beam is emitted from the light emitting element N for the purpose of detecting the BD signal 502. In this way, by adjusting the light powers of the light emitting elements that are to be used in measurement to a light power target value before starting the measurement of the BD signal time interval (beam interval), the light powers of the light emitting elements at the time of measurement can be made stable, and the above-mentioned measurement errors can be suppressed.

Note that in the measurement period 2 as well, the CPU 401 similarly generates the count value $C_{DT}$ indicating the time interval DT2 between the BD signal 503 and the BD signal 504. Also, in the measurement period 2 as well, the CPU 401 executes APC on the light emitting elements 1 and N before measuring the time interval between the BD signals 503 and 504, and thereby adjusts the light powers of the light emitting elements 1 and N to the pre-set light power target value. That is to say, the CPU 401 executes APC on the light emitting elements 1 and N at timings (APC T'1, APC T'2) that are before when the laser beams are emitted from the light emitting elements 1 and N for the purpose of detecting the BD signals 503 and 504.

A beam emission timing control method using the beam interval measurement result will be described next. In the present embodiment, a reference value that is to be used as a reference for the beam emission timing control for the light emitting elements, and timing values that are set in association with the reference value and indicate the laser emission timings for the light emitting elements are stored in advance in the memory 406. By adjustment (measurement) in the assembly step at the factory, the reference value and the timing values are generated as initial values for the laser emission control for the light emitting elements and stored in the memory 406. Also, in the laser emission timing control, for each of the light emitting elements 1 to N, the laser emission timing is adjusted using a value obtained by correcting the timing value according to the difference between the beam interval measurement result and the reference value stored in the memory 406.

FIG. 9 shows an example of reference values and timing values for beam emission timing control of the light emitting elements. In the present embodiment, reference count values $C_{ref}$ that correspond to the light power target value are stored in the memory 406 as reference values. Also, count values $C_1$ to $C_N$ for the light emitting elements 1 to N that correspond to the reference count values $C_{ref}$ are stored in the memory 406 as timing values. That is to say, the reference values and timing values are generated in advance in association with multiple levels that can be set as the light power target value, and are stored in the memory 406.

For example, if the light power target value (target light power) for the light emitting elements is set to 100% using the density adjustment operation, $C_{ref_100}$, $C_{1_100}$, and $C_{N_100}$ shown in FIG. 9 are used as $C_{ref}$, $C_1$, and $C_N$ in the beam emission timing control. Note that in the present embodiment, as shown in FIG. 9, only $C_1$ and $C_N$ for the light emitting elements 1 and N are stored in advance in the memory 406, and $C_2$ to $C_{N-1}$ for the other light emitting elements (light emitting elements 2 to (N−1)) are obtained based on $C_1$ and $C_N$, as will be described later.

The reference count value $C_{ref}$ and the count values $C_1$ to $C_N$ are values that are obtained by measurement corresponding to different light power target values at the time of factory adjustment. The reference count value $C_{ref}$ is a value that corresponds to a time interval $T_{ref}$ between BD signals that are generated in the image forming apparatus 100 (optical scanning apparatus 104) in a specific state and correspond to the light emitting elements 1 and N. In the present embodiment, the reference count value $C_{ref}$ is a value that corresponds to the time interval between BD signals generated in an initial state at the time of factory adjustment, as described above. The count values $C_1$ to $C_N$ are values for causing the writing start positions in the main scanning direction for the electrostatic latent images corresponding to the light emitting elements to coincide with each other in the case where the time interval between the generated BD signals is $T_{ref}$. In this way, $T_{ref}$ ($C_{ref}$) is the reference value for the time interval between the BD signals and corresponds to the reference value that serves as the reference for adjusting the laser emission timings.

The reference count value $C_{ref}$ and the count values $C_1$ to $C_N$ can be set in advance as follows. First, an optical system is envisioned in which, when two laser beams emitted from two light emitting elements used for measurement scan the photosensitive drum, the time interval of detection of the two laser beams by the BD sensor 207 (detection time interval) is equal to the time interval of scanning by the two laser beams on the photosensitive drum 102 (scanning time interval). In such a case, one of the detection time interval $T_{ref}$ of laser beams by the BD sensor 207, and the scanning time interval on the photosensitive drum 102 may be measured at the time of factory adjustment, the other is derived based on that measurement result, and thereby $C_{ref}$ and $C_1$ to $C_N$ may be set.

On the other hand, errors that are dependent on variation in the spot size of the corresponding laser beams on the light-receiving surface 207*a*, variation in the light power, or the like sometimes occur in the detection time interval of laser beams by the BD sensor 207. In such a case, the interval between the image forming positions of the laser beams on the photosensitive drum 102 are measured at the same time as $T_{ref}$ is measured at the time of factory adjustment. Furthermore, $C_{ref}$ and $C_1$ to $C_N$ may be set based on these measurement results such that the variation as described above is canceled out. Also, in the case of an optical system in which the detection time interval (scanning speed) of laser beams by the BD sensor 207 and the scanning time interval (scanning speed) on the photosensitive drum 102 are different, $C_{ref}$ and $C_1$ to $C_N$ may be set similarly such that the difference between the scanning speeds is canceled out.

(In Case of $C_{DT}=C_{ref}$)

Control for the laser emission timings of the light emitting elements ($LD_n$) based on the count value $C_{DT}$ obtained by the above-described measurement will be described next. First, it is presumed that the count value $C_{DT}$ obtained by the measurement in the measurement period 1 shown in FIG. 5A is equal to the reference count value $C_{ref}$ that was stored in advance in the memory 406. This means that the measurement result DT1 for the time interval between the BD signals 501 and 502 indicated by the count value $C_{DT}$ is equal to the reference value $T_{ref}$ ($DT1=T_{ref}$). In this case, the count values $C_1$ to $C_N$ that were stored in advance in the memory 406 are directly used to control the laser emission timings of the light emitting elements, and it is thereby possible make the image writing start positions for the laser beams coincide with each other.

The timing at which the BD signal 501 was generated is used as a reference by the CPU 401 to control the laser driver 403 such that the light emitting elements 1 to N ($LD_1$ to $LD_N$) are sequentially turned on (emit light) at the emission timings corresponding to the count values $C_1$ to $C_N$. Here, $T_1$ to $T_N$ shown in FIG. 5A are amounts of time corresponding to the count values $C_1$ to $C_N$. The CPU 401 starts the count of the CLK signal from the timing at which the BD signal 501 was generated, and turns on the light emitting element 1 in response to the count value reaching $C_1$ (when $T_1$ has elapsed). Next, the CPU 401 turns on the light emitting element 2 in response to the count value reaching $C_2$ (when $T_2$ has elapsed). The CPU 401 performs similar control with respect to the other light emitting elements as well, and finally turns on the light emitting element N in response to the count value reaching $C_N$ (when $T_N$ has elapsed).

By doing so, the CPU 401 adjusts the laser emission timings for the light emitting elements 1 to N such that the positions at which the forming of the electrostatic latent images starts coincide with each other between the multiple main scanning lines on the photosensitive drum 102 that are scanned by the light emitting elements 1 to N. According to this, the writing start positions for the images to be formed by the laser beams emitted from the light emitting elements 1 to N in the main scanning direction can be caused to coincide with each other.

Here, it is possible to store only the count values $C_1$ and $C_N$ that correspond to the light emitting elements 1 and N as timing values in the memory 406. That is to say, the count values $C_2$ to $C_{N-1}$ corresponding to light emitting elements n ($2 \le n \le N-1$), which are positioned between the light emitting element 1 and the light emitting element N shown in FIG. 3A, may be obtained based on Equation (1) below rather than being stored in the memory 406. Specifically, the CPU 401 may calculate the count value $C_n$ for controlling the laser emission timing for the light emitting element n ($2 \le n \le N-1$) using the following equation:

$$C_n = C_1 + (C_N - C_1) \times (n-1)/(N-1) \quad (1)$$
$$= C_1 \times (N-n)/(N-1) + C_N \times (n-1)/(N-1)$$

For example, in the case where the light source 201 includes four light emitting elements 1 to 4 ($LD_1$ to $LD_4$), the CPU 401 calculates the count values $C_2$ and $C_3$ corresponding to the light emitting elements 2 and 3 based on the following equations.

$$C_2 = C_1 + (C_4 - C_1) \times 1/3 = C_1 \times 2/3 + C_4 \times 1/3 \quad (2)$$

$$C_3 = C_1 + (C_4 - C_1) \times 2/3 = C_1 \times 1/3 + C_4 \times 2/3 \quad (3)$$

Thus, the laser emission timings for the light emitting elements may be determined by performing an interpolation calculation based on the count values $C_1$ and $C_N$ ($T_1$ and $T_N$) that correspond to the light emitting elements 1 and N, such that the laser emission timings of the light emitting elements 1 to N have equal time intervals.

(In case of $C_{DT} \neq C_{ref}$)

Next, it is presumed that a deviation from the reference count value $C_{ref}$ that was stored in advance in the memory 406 has occurred in the count value $C_{DT}$ obtained by the measurement in the measurement period 2 shown in FIG. 5A. This means that the measurement result DT2 for the time interval between the BD signals 503 and 504 indicated by the count value $C_{DT}$ is not equal to the reference value $T_{ref}$ ($DT2 \neq_{ref}$). In this case, the CPU 401 corrects the count values $C_1$ to $C_N$ based on the difference between the count value $C_{DT}$ and the reference count value $C_{ref}$, thereby deriving the count values $C'_1$ to $C'_N$ for controlling the laser emission timings of the light emitting elements. By controlling the laser emission timings of the light emitting elements using the derived count values $C'_1$ to $C'_N$, it is possible to make the image writing start positions for the laser beams coincide with each other.

Specifically, the CPU 401 first sets the count value $C_1$ stored in the memory 406 to the count value $C'_1$ for controlling the laser emission timing of the light emitting element 1 ($T'_1=T_1$). Note that $T'_1$ to $T'_N$ shown in FIG. 5A are amounts of time corresponding to the count values $C'_1$ to $C'_N$ respectively. Next, the CPU 401 uses the following equation to correct $C_N$ based on the difference between the count value $C_{DT}$ and the reference count value $C_{ref}$, and thereby sets the count value $C'_N$ ($T'_N$) for controlling the laser output timing of the light emitting element N.

$$C'_N = C_N + K(C_{DT} - C_{ref}) \text{ (K is any coefficient, including 1)} \quad (4)$$

Here, the coefficient K is a coefficient for performing weighting on the amount of change from the reference value ($C_{DT} - C_{ref}$) for the detection time interval of laser beams by the BD sensor 207, and the coefficient K can be determined according to the characteristics of the optical system. For example, K=1 is used in an optical system in which, when two laser beams emitted from two light emitting elements used for measurement scan the photosensitive drum 102, the detection time interval of the laser beams by the BD sensor 207 is equal to the scanning time interval on the photosensitive drum 102. On the other hand, in an optical system in which the detection time interval (scanning speed) of the laser beams by the BD sensor 207 and the scanning time interval (scanning speed) on the photosensitive drum 102 are different, the coefficient K is determined according to the ratio between the detection time interval and the scanning time interval.

Figure 2B:
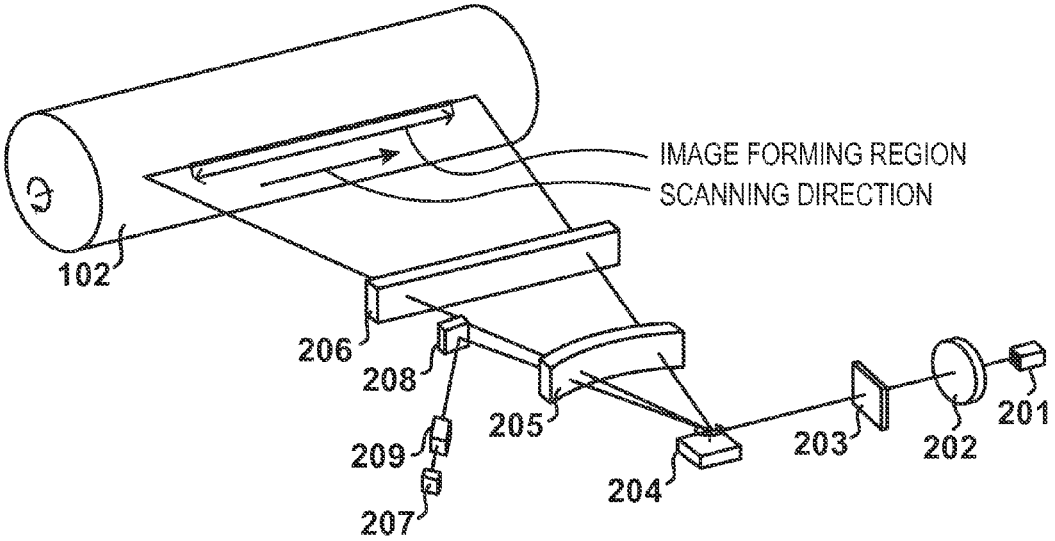
FIG. 2B is a diagram showing a modified example of a configuration of an optical scanning apparatus 104 that scans the surface of a photosensitive drum using light beams, according to the first embodiment.

An example of an optical system in which the coefficient K is determined to be a value other than 1 ($K \neq 1$) is the configuration of the optical scanning apparatus 104 shown in FIG. 2B. In the optical scanning apparatus 104 shown in FIG. 2B, after passing through the scanning lens 205, the laser beams are reflected by the reflection mirror 208 and form images on the light-receiving surface 207*a* of the BD sensor 207 by the BD lens 209. In this case, the laser beam that scans the BD sensor 207 passes through the BD lens 209, whereas the laser beam that scans the photosensitive drum 102 passes through the scanning lens 206. In this way, when laser beams are to scan scanning targets via independent lenses, the scanning speed on the BD sensor 207 and the scanning speed on the photosensitive drum 102 can be different speeds depending on the relationship between the magnification of the lens and the distance of the focal point from the lens. Accordingly, in the optical system shown in FIG. 2B, the coefficient K may be determined according to the ratio between the scanning speeds as described above.

Note that in an optical system other than the optical system shown in FIG. 2B as well, there is a probability that the scanning speed on the BD sensor 207 and the scanning speed on the photosensitive drum 102 are to be different speeds due to an optical component attachment error in the assembly step or the like. In such a case, the coefficient K may be determined experimentally using the optical system. Also, the coefficient K may be derived and determined for each image forming apparatus (optical scanning apparatus) at the time of factory adjustment. Note that the coefficient K may be determined by, for example, changing the temperature of the measuring environment and deriving the scanning speed on the BD sensor 207 and the scanning speed on the photosensitive drum 102 before and after the temperature change.

Next, the CPU 401 may use an interpolation calculation based on Equations (1) to (3) to determine the count values $C'_n$ for controlling the laser emission timings of the light emitting elements n ($2 \leq n \leq N-1$) that are other than the light emitting elements 1 and N. That is to say, an interpolation calculation based on the count values $C'_1$ and $C'_N$ that have been set for the light emitting elements 1 and N is performed by the CPU 401 such that the laser emission timings of the light emitting elements 1 to N have equal time intervals. According to this, the corrected laser emission timings $C'_n$ ($T'_n$) may be set for the light emitting elements 2 to (N−1).

Thereafter, the timing at which the BD signal 503 was generated is used as a reference by the CPU 401 to control the laser driver 403 such that the light emitting elements 1 to N ($LD_1$ to $LD_N$) are sequentially turned on at the emission timings corresponding to the count values $C_1$ to $C_N$. Here, $T'_1$ to $T'_N$ shown in FIG. 5A are amounts of time corresponding to the count values $C'_1$ to $C'_N$. The CPU 401 starts the count of the CLK signal from the timing at which the BD signal 501 was generated, and turns on the light emitting element 1 in response to the count value reaching $C'_1$ (when $T'_1$ has elapsed). Next, the CPU 401 turns on the light emitting element 2 in response to the count value reaching $C'_2$ (when $T'_2$ has elapsed). The CPU 401 performs similar control for the other light emitting elements as well, and finally turns on the light emitting element N in response to the count value reaching $C'_N$ (when $T'_N$ has elapsed).

By doing so, the CPU 401 adjusts the laser emission timings of the light emitting elements 1 to N such that the positions at which the forming of the electrostatic latent images starts coincide with each other between the multiple main scanning lines on the photosensitive drum 102 that are scanned by the light emitting elements 1 to N. According to this, even when the measured value for the time interval between the BD signals changes from the reference value, the writing start positions for the images to be formed by the laser beams emitted from the light emitting elements 1 to N can be caused to coincide with each other in the main scanning direction.

(Operation in Non-Measurement Period)

During a non-measurement period in which beam interval measurement is not performed, as shown in FIG. 5B, laser emission timing control for the light emitting elements 1 to N is performed based on the count values $C_1$ to $C_N$ (or corrected count values $C'_1$ to $C'_N$) that were set in the previous measurement period. During a non-measurement period, as described above, APC is executed sequentially not only on the light emitting elements 1 and N that are to be used in the beam interval measurement, but on all of the light emitting elements 1 to N included in the light source 201, based on the light power target value set using the above-described density adjustment operation.

The present embodiment assumes a case in which the period corresponding to the non-image region (non-image-forming region) is short, and APC cannot be completed for all of the light emitting elements 1 to N in this period. In such a case, APC is successively executed on the light emitting elements by designating, for each laser beam scanning cycle, a predetermined number of light emitting elements (in this case, 2) among the light emitting elements 1 to N as APC execution targets in order, as shown in FIG. 5B. Also, APC is executed while the laser beams scan a region that is not an image region (non-image region) for each laser beam scanning cycle. For example, in the non-image region of the first cycle, APC is executed on the light emitting elements 1 and 2 ($LD_1$ and $LD_2$), and thereby the light powers of the light emitting elements 1 and 2 are controlled so as to be the pre-set light power. In the subsequent non-image region of the second cycle, APC is executed on the light emitting elements 3 and 4 ($LD_3$ and $LD_4$), and thereby the light powers of the light emitting elements 3 and 4 are controlled so as to be the pre-set light power. APC is sequentially executed on two light emitting elements every laser beam scanning cycle in this way.

In a non-measurement period, if a measurement period is reached while APC is being sequentially executed on the light emitting elements, the CPU 401 controls the laser driver 403 such that APC is executed for the light emitting elements 1 and N, regardless of the APC execution sequence during the non-measurement period. That is to say, in response to the measurement period being reached, among the light emitting elements 1 to N, APC for the light emitting elements 1 and N that are to be used in the beam interval measurement is executed with priority over APC for the other light emitting elements. According to this, even if the APC execution target is being switched regularly among the light emitting elements 1 to N, it is possible to make the light powers of the light emitting elements 1 and N stable and suppress measurement errors when the beam interval measurement is to be performed.

Image Formation Processing Performed by the Image Forming Apparatus

Figure 6A:
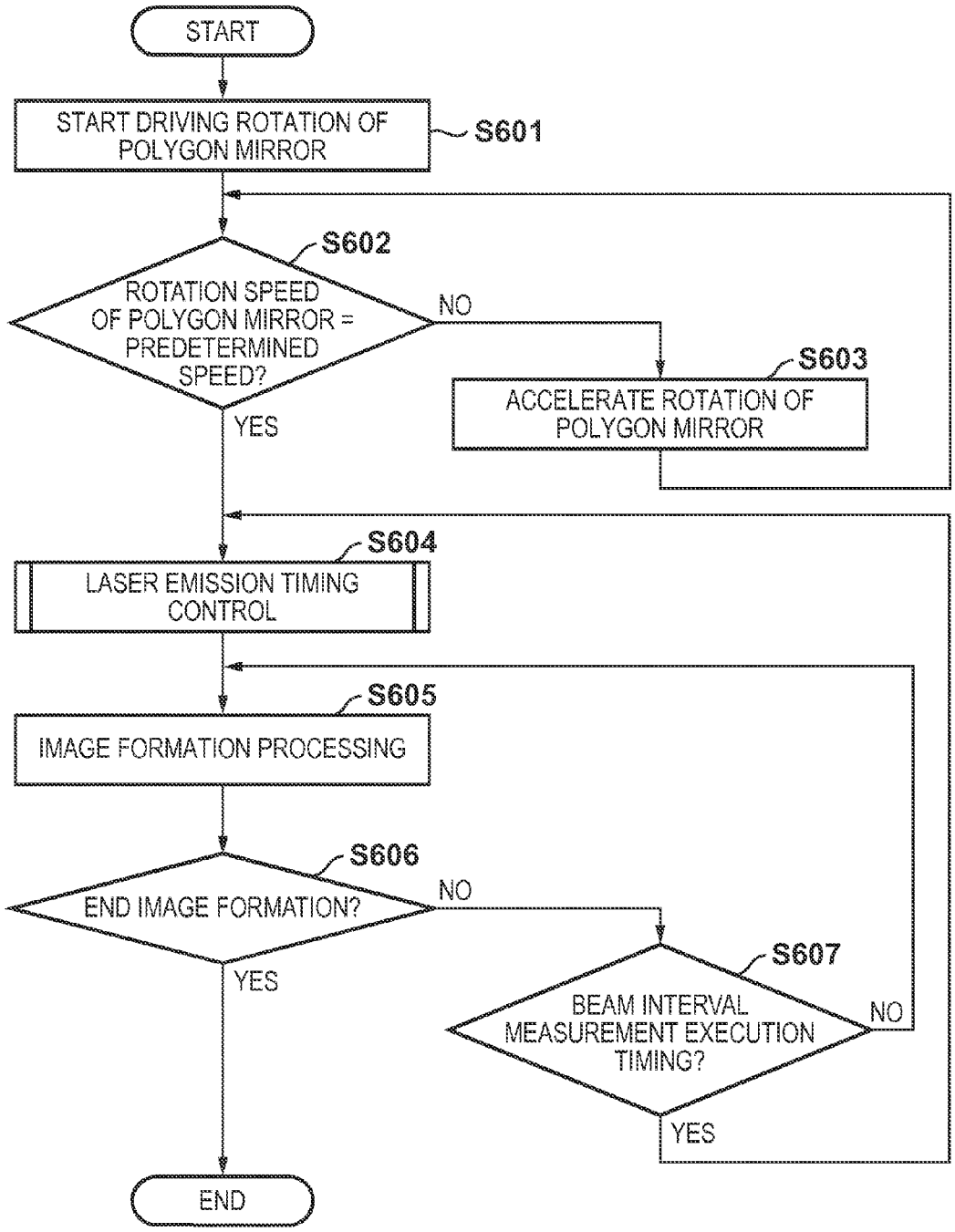
FIG. 6A is a flowchart showing a procedure of image formation processing executed by the image forming apparatus according to the first embodiment.

FIG. 6A is a flowchart showing a procedure of image formation processing executed by the image forming apparatus 100 according to the present embodiment. The processing of the steps shown in FIG. 6A is realized in the image forming apparatus 100 by the CPU 401 reading out a control program stored in the memory 406 and executing it. The processing of step S601 starts in response to image data being input to the image forming apparatus 100.

In step S601, in response to the input of the image data, the CPU 401 starts the driving of the motor 407, thereby causing the rotation of the polygon mirror 204 to start, and in step S602, the CPU 401 determines whether or not the rotation speed of the polygon mirror 204 has reached a predetermined rotation speed. If it is determined in step S602 that that the rotation speed of the polygon mirror 204 has not reached the predetermined speed, the CPU 401 advances the process to step S603, causes the rotation of the polygon mirror 204 to accelerate such that the rotation speed approaches the predetermined rotation speed, and performs the determination processing of step S602 once again. If it is determined in step S602 that the rotation speed of the polygon mirror 204 has reached the predetermined rotation speed, the CPU 401 advances the process to step S604.

Figure 6B:
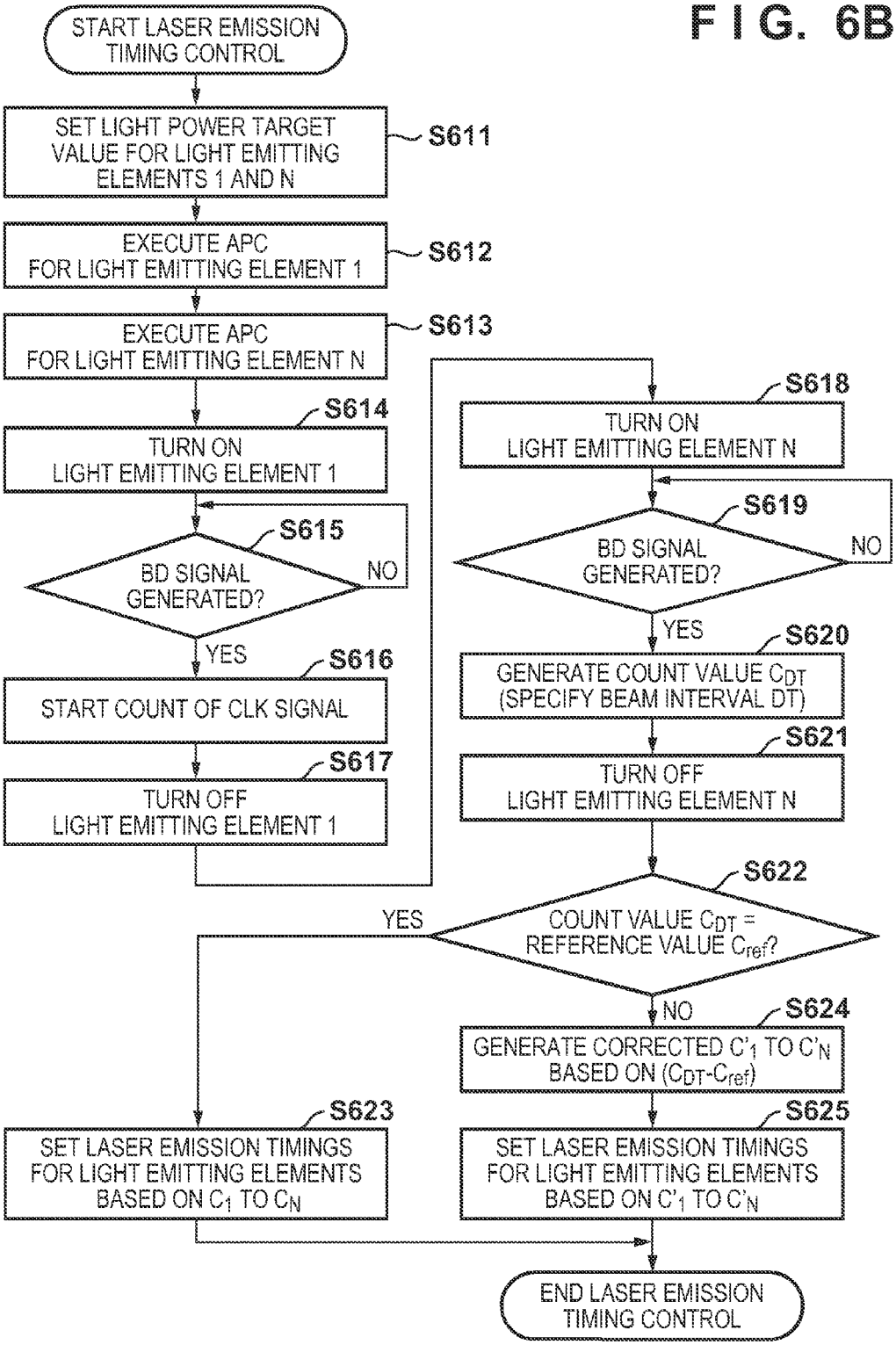
FIG. 6B is a flowchart showing a procedure for laser emission timing control executed in step S604 (FIG. 6A) and step S1004 (FIG. 10).

In step S604, the CPU 401 controls the laser emission timings of the light emitting elements 1 to N in accordance with the procedure shown in FIG. 6B using the two BD signals generated based on the laser beams emitted from the light emitting elements 1 and N. Note that the present embodiment has described an example in which the CPU 401 executes the processing of step S604 (FIG. 6B), but the processing of step S604 may be executed by a control unit provided independently from the CPU 401 in the laser driver 403. In this case, the control unit in the laser driver 403 may operate in accordance with an instruction from the CPU 401 and executes the beam interval measurement based on the CLK signal input from the CLK signal generation unit 404 and the BD signals input from the BD sensor 207. Also, the control unit in the laser driver 403 may control the laser emission timings in accordance with an instruction from the CPU 401.

As shown in FIG. 6B, in step S611, the CPU 401 first sets, in the laser driver 403, the light power target value for the light emitting elements 1 and N that is to be used in the beam interval measurement is set. Next, in step S612, the CPU 401 controls the laser driver 403 to turn on the light emitting element 1, execute APC on the light emitting element 1, and then turn off the light emitting element 1 after the APC has ended. Similarly, in step S613, the CPU 401 controls the laser driver 403 to switch on the light emitting element N, execute APC on the light emitting element N, and then switch off the light emitting element N after the APC has ended.

Next, in step S614, the CPU 401 causes the laser driver 403 to turn on the light emitting element 1 using the light power resulting from executing APC. Subsequently, in step S615, based on the output from the BD sensor 207, the CPU 401 determines whether or not a BD signal has been generated according to the laser beam emitted from the light emitting element 1. As long as it is determined in step S615 that a BD signal has not been generated, the CPU 401 repeats the determination processing of step S615, and upon determining that a BD signal has been generated, the CPU 401 advances the process to step S616. In response to the generation of the BD signal, the CPU 401 starts the count of the CLK signals using the counter in step S616 and causes the laser driver 403 to turn off the light emitting element 1 in step S617.

Next, in step S618, the CPU 401 causes the laser driver 403 to turn on the light emitting element N using the light power resulting from executing APC. Subsequently, based on the output from the BD sensor 207, the CPU 401 determines in step S619 whether or not a BD signal has been generated according to the laser beam emitted from the light emitting element N. As long as it is determined in step S619 that a BD signal has not been generated, the CPU 401 repeats the determination processing of step S619, and upon determining that a BD signal has been generated, the CPU 401 advances the process to step S620. In step S620, the CPU 401 generates the count value $C_{DT}$ by sampling the count value of the clock signal counted by the counter 402, and in step S621, the CPU 401 causes the laser driver 403 to turn off the light emitting element N.

Next, in step S622, the CPU 401 compares the count value $C_{DT}$ and the reference count value (reference value) $C_{ref}$ to determine whether or not $C_{DT}=C_{ref}$. If it is determined that $C_{DT}=C_{ref}$, the CPU 401 advances the process to step S623. In step S623, as described above, the CPU 401 sets the laser beam emission timings $T_1$ to $T_N$ for the light emitting elements based on $C_1$ to $C_N$ using, as a reference, the generation time of the BD signal generated according to the laser beam L1 emitted from the light emitting element 1. $C_{ref}$ and $C_1$ to $C_N$, which are used in steps S622 and S623, correspond to the reference value and the timing values (FIG. 9) that correspond to the light power target value set in step S611, and these values are read out from the memory 406 at any time.

On the other hand, if it is determined in step S622 that $C_{DT}\neq C_{ref}$, the CPU 401 advances the process to step S624. In step S624, the CPU 401 calculates $C_{cor}=C_{DT}-C_{ref}$, corrects $C_1$ to $C_N$ as described above based on $C_{cor}$, and thereby generates $C'_1$ to $C'_N$. Furthermore, in step S625, as described above, the CPU 401 sets the laser beam emission timings $T_1$ to $T_N$ for the light emitting elements based on $C'_1$ to $C'_N$ using, as a reference, the generation time of the BD signal generated according to the laser beam $L_1$ emitted from the light emitting element 1.

In this manner, the CPU 401 ends the laser emission timing control for the light emitting elements 1 to N using the two BD signals generated based on the laser beams emitted from the light emitting elements 1 and N in step S604, and advances the process to step S605.

Returning to FIG. 6A, in step S605, the CPU 401 starts image formation processing based on the input image data. Specifically, the CPU 401 executes an exposure process in which the photosensitive drum 102 is exposed by causing the laser beams $L_1$ to $L_N$ that are based on the image data to be emitted from the light emitting elements 1 to N in accordance with the laser emission timings set in step S623 or step S625. Furthermore, the CPU 401 forms an image on the recording medium S by executing other processes such as a developing process and a transfer process.

Each time image formation for one page is executed thereafter for example, the CPU 401 determines in step S606 whether or not to end the image formation. For example, if a page that is an image formation target remains, the CPU 401 determines that image formation is not to end and advances the process to step S607, whereas if it is determined that the image formation is to end, the CPU 401 ends the series of processes shown in FIG. 6A.

In the present embodiment, as described with reference to FIG. 5A, the beam interval measurement is executed and the laser emission timings of the light emitting elements are controlled periodically (e.g., every image formation of 100 pages). In view of this, the CPU 401 determines in step S607 whether or not the execution timing of the beam interval measurement has been reached, and if it is determined that the execution timing has been reached, the CPU 401 returns the process to step S604 and executes the laser emission timing control (FIG. 6B). On the other hand, if it is determined that the execution timing has not been reached, the CPU 401 returns the process to S605 and continues image formation processing.

As described above, the image forming apparatus 100 according to the present embodiment executes, before starting execution of the beam interval measurement, APC on the light emitting elements 1 and N that are to be used in the measurement, and thereby the light powers of the laser beams emitted from the light emitting elements 1 and N at the time of measurement can be made stable. As a result, it is possible to suppress measurement errors in the beam interval measurement and to improve the correction accuracy of the image writing start positions for the light emitting elements.

Second Embodiment

In the above-described first embodiment, the light emitting elements 1 and N that are to be used in the measurement are subjected to APC before the beam interval measurement is started, such that the light powers correspond to the light power target value set using the above-described density adjustment operation. In this case, for example, when a relatively low value is set as the light power target value, the incident light power on the BD sensor 207 decreases, and there is a possibility that the rising rate of the waveform of the BD signal output from the BD sensor 207 will decrease. As a result, there is a possibility that an irregularity such as a jitter will appear in the measurement result for the BD signal time interval.

In view of this, as a second embodiment, an example will be described in which, in order to furthermore improve the measurement accuracy for the time interval (beam interval) between the BD signals, the light power target value is set such that the light powers of the laser beams emitted by the light emitting elements 1 and N that are to be used in the measurement always become a constant light power at the time of measurement. That is to say, the light powers emitted by the light emitting elements 1 and N at the time of the beam interval measurement are set in advance as light powers that are independent from the light power target value of the laser beams emitted from the light emitting elements 1 to N at the time of scanning the image region on the surface of the photosensitive drum 102. According to this, the light powers of the laser beams emitted from the light emitting elements 1 and N at the time of measurement are enabled to be constant light powers that are independent from the light power target value. Note that in order to simplify the description below, the description of portions in common with the first embodiment will not be repeated.

In the present embodiment, the light power target value at the time of beam interval measurement is determined such that a predetermined condition is satisfied, such as a condition in which the incident light power on the BD sensor 207 is greater than or equal to a predetermined value in the adjustment using a predetermined jig at the time of factory adjustment. The determined light power target value is stored in advance in the memory 406 as the initial value. The light power target value stored in the memory 406 is used as the light power target value for the light emitting elements 1 and N that is set in step S611 (FIG. 6B) and is to be used in the beam interval measurement. Also, at the time of factory adjustment, the reference count value $C_{ref}$ that corresponds to the determined light power target value, and the count values $C_1$ to $C_N$ (or $C_1$ and $C_N$ only) that correspond to $C_{ref}$ are determined and stored in advance in the memory 406. These values are used in the laser emission timing control (FIG. 6B), similarly to the first embodiment.

In the present embodiment, at the time of measuring the pulse interval, APC is performed on the light emitting elements 1 and N such that the light powers of the light emitting elements 1 and N that are to be used in the measurement are always equal to the initial value that was stored in advance in the memory 406 (constant light power). On the other hand, at the time of executing image formation that is based on image data, APC needs to be performed on the light emitting elements such that the light powers of the light emitting elements are to be light powers resulting from the adjustment performed using the density adjustment operation in the image forming apparatus 100. Accordingly, with respect to the light emitting elements 1 and N, it is necessary to switch between the light powers corresponding to the operations at the time of pulse interval measurement and those corresponding to the operations at the time of image formation.

Laser Emission Timing Control Based on Two BD Signals

Figure 11:
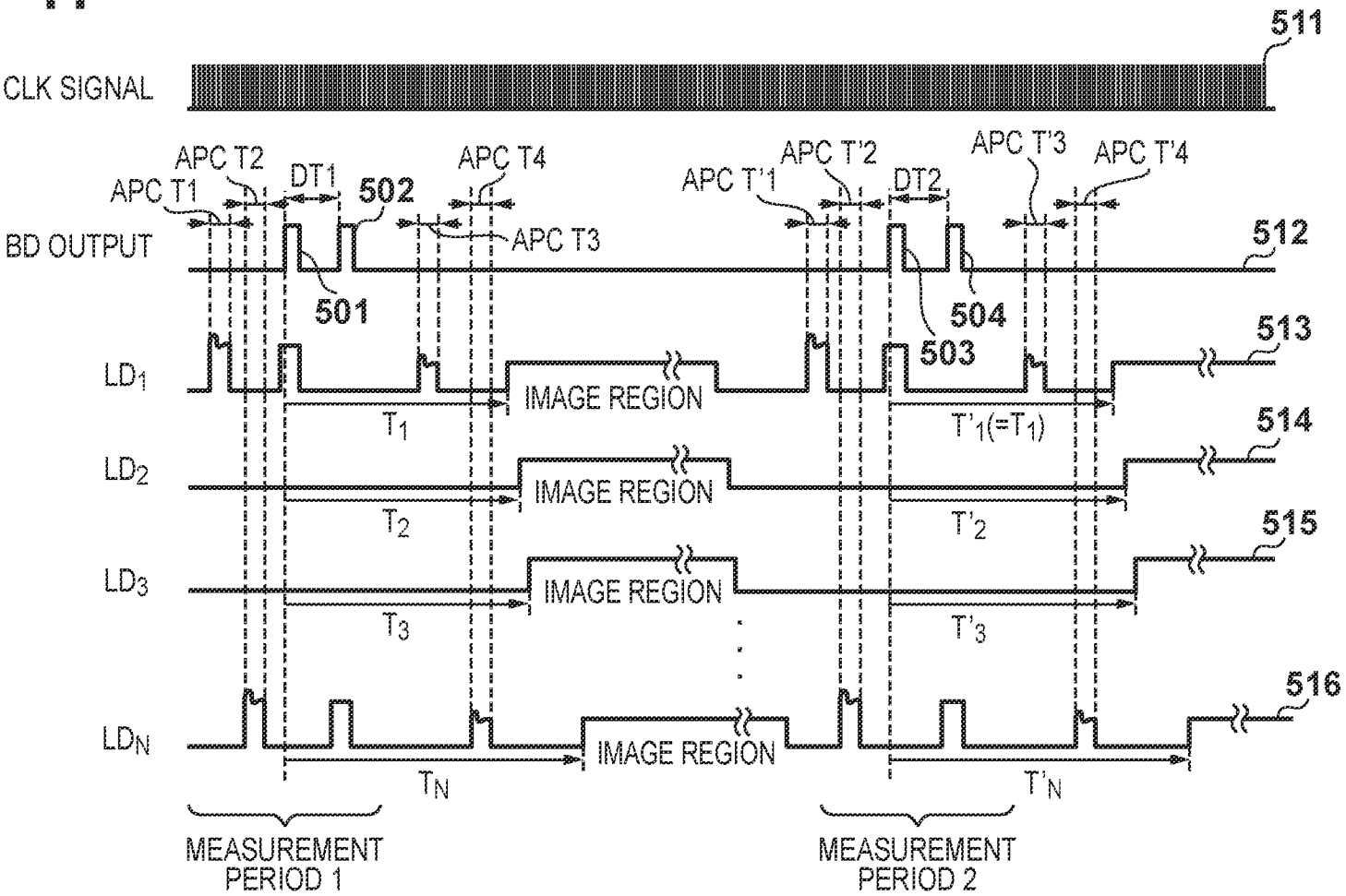
FIG. 11 is a timing chart showing the timing of operations performed by the optical scanning apparatus according to the second embodiment.

FIG. 11 is a timing chart showing the timing of operations performed by the optical scanning apparatus 104 according to the present embodiment. This figure shows a CLK signal 511, an output signal 512 from the BD sensor 207, and light powers 513 to 516 of the laser beams output by the light emitting elements 1, 2, 3, and N respectively.

In FIG. 11, the beam interval between the laser beams $L_1$ and $L_N$ that correspond to the light emitting elements 1 and N ($LD_1$ and $LD_N$) is measured in the measurement periods 1 and 2. After the laser beams $L_1$ and $L_N$ have passed over the BD sensor 207 in a measurement period, the CPU 401 switches the light powers of the light emitting elements 1 and N by executing APC before starting the scanning of the image region on the photosensitive drum 102.

First, in the measurement period 1, the CPU 401 executes APC on the light emitting element 1 at a timing before when the laser beam is emitted from the light emitting element 1 for the purpose of detecting the BD signal 501 (APC T1), such that the light power is equal to the initial value stored in the memory 406. Furthermore, the CPU 401 executes APC on the light emitting element N at a timing before the laser beam is emitted from the light emitting element N for the purpose of detecting the BD signal 502 (APC T2), such that the light power is equal to the initial value stored in the memory 406. According to this, the CPU 401 generates a count value $C_{DT}$ that indicates the time interval DT1 between the BD signal 501 and the BD signal 502.

Subsequently, at timings after when the laser beams $L_1$ and $L_N$ pass over the BD sensor 207 and before when the image region is reached (APC T3, APC T4), the CPU 401 executes APC on the light emitting elements 1 and N such that the light emitting elements 1 and N have the light powers that were set using the density adjustment operation. According to this, the light powers of the light emitting elements 1 and N are switched between the pulse interval measurement time and the image formation time.

Image Formation Processing Performed by the Image Forming Apparatus

Figure 10:
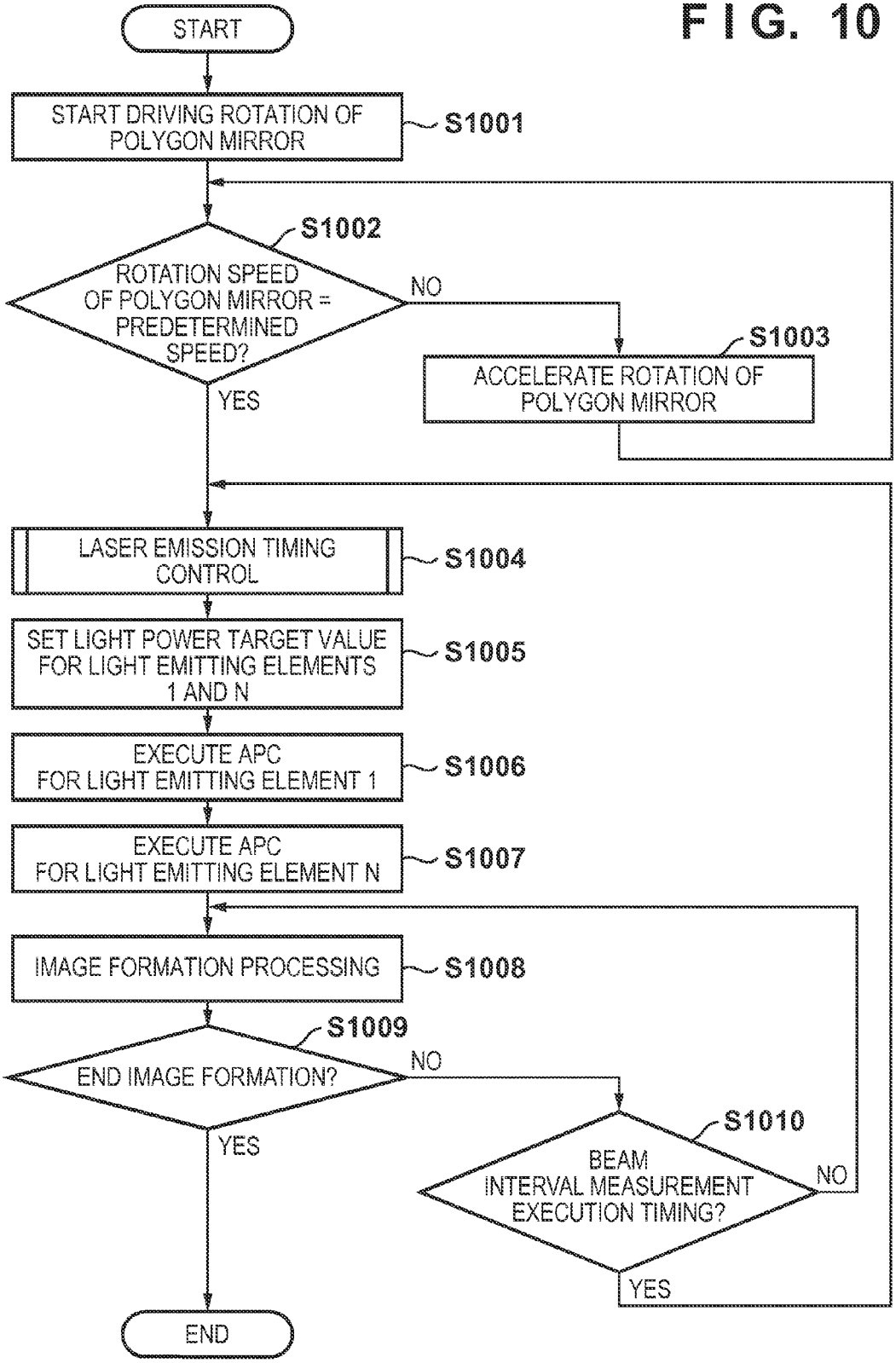
FIG. 10 is a flowchart showing a procedure of image formation processing executed by the image forming apparatus according to a second embodiment.

FIG. 10 is a flowchart showing a procedure of image formation processing executed by the image forming apparatus 100 according to the present embodiment. The processing of the steps shown in FIG. 10 is realized in the image forming apparatus 100 by the CPU 401 reading out a control program stored in the memory 406 and executing it. Note that FIG. 10 differs from the first embodiment (FIG. 6A) in particular in that steps S1005 to S1007 are newly provided. The processing of step S1001 starts in response to the image data being input to the image forming apparatus 100. First, in steps S1001 to S1003, the CPU 401 executes processing that is similar to that of steps S601 to S603 (FIG. 6A) in the first embodiment.

In step S1004, the CPU 401 uses the two BD signals that are generated based on the laser beams emitted from the light emitting elements 1 to N to control the laser emission timings of the light emitting elements 1 to N in accordance with the procedure shown in FIG. 6B, similarly to the case of the first embodiment. However, in step S611, the CPU 401 sets, in the laser driver 403, the value that was stored in advance in the memory 406 as the initial value as described above, as the light power target value for the light emitting elements 1 and N that are to be used in the beam interval measurement. When the laser emission timing control for the light emitting elements 1 to N in step S1004 ends, which uses the two BD signals that are generated based on the laser beams emitted from the light emitting elements 1 and N, the CPU 401 advances the process to step S1005.

In steps S1005 to S1007, the CPU 401 executes APC on the light emitting elements 1 and N, and thereby adjusts the light powers of the light emitting elements 1 and N to the light powers that were set using the density adjustment operation. First, in step S1005, the value that was set using the density adjustment operation is set in the laser driver 403 by the CPU 401 as the light power target value that is to be used in the APC for the light emitting elements 1 and N. Next, in step S1006, the CPU 401 controls the laser driver 403 to execute the APC for the light emitting element 1 and turn off the light emitting element 1 after the APC ends. Furthermore, in step S1007, the CPU 401 controls the laser driver 403 to execute the APC for the light emitting element N and turn off the light emitting element N after the APC ends.

Subsequently, in step S1008, the CPU 401 starts image formation processing that is based on input image data. In steps S1008 to S1010, the CPU 401 executes the same processing as that of steps S605 to S607 (FIG. 6A) in the first embodiment.

As described above, in the present embodiment, before starting image formation, the light powers of the light emitting elements 1 and N that are to be used in the beam interval measurement are switched at the time of measurement and at the time of image formation while the laser beams scan the non-image region. Specifically, the light powers of the laser beams emitted from the light emitting elements 1 and N at the time of measurement are always controlled so as to be constant light powers, independently of the target light power at the time of image formation. According to this, the light powers of the laser beams emitted from the light emitting elements 1 to N at the time of beam interval measurement can be made stable even if the light power target value that was set using the density adjustment operation is a value that is relatively low. As a result, it is possible to suppress measurement errors in the beam interval measurement and to improve the correction accuracy of the image writing start positions for the light emitting elements.

Note that even in the case of performing the beam interval measurement before starting image formation or between pages (between sheets) as well, the light powers of the light emitting elements 1 and N that are to be used in the measurement are set to the predetermined light power (initial value) at the time of measurement, and are switched to light powers that correspond to the image density at the time of image formation.

The above-described first and second embodiments described an example in which the light powers of the light emitting elements 1 and N at the time of the beam interval measurement are set to a light power target value that was set using the above-described density adjustment operation, or to a predetermined constant light power target value (initial value). In these embodiments, basically, it is a prerequisite that the light powers of the light emitting elements 1 and N are controlled so as to be at levels at which the response speed of the BD sensor 207 is ensured to a certain extent. However, if the BD sensor 207 has a characteristic in which the amount of change in the laser beam detection timing is constant with respect to changes in the light powers of the laser beams incident on the light-receiving surface 207*a*, the light powers of the light emitting elements 1 and N at the time of the beam interval measurement may simply be controlled so as to be light powers that are relatively equal to each other. That is to say, the light powers of the light emitting elements 1 and N are controlled so as to be equal light powers even if they are low in value, and according to this, errors will not occur in the measurement result of the beam interval measurement due to changes in light power.

Figure 12:
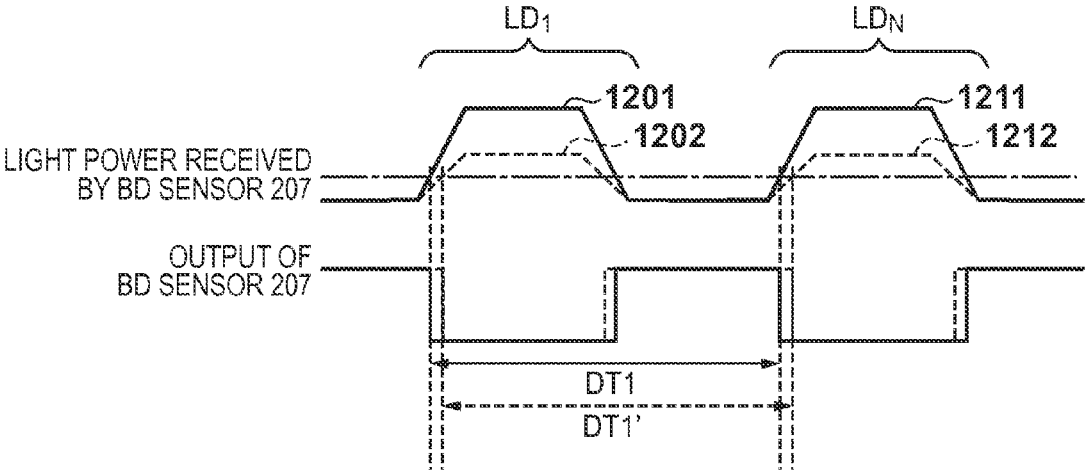
FIG. 12 is a diagram showing an example of a relationship between received light power of the BD sensor and a time interval between BD signals output from the BD sensor in the optical scanning apparatus according to another embodiment.

FIG. 12 is a diagram showing an example of the relationship between the received light power of the BD sensor 207 and the time interval between the BD signals output by the BD sensor 207 in the optical scanning apparatus 104 that includes the BD sensor 207 having the above-described characteristic. FIG. 12 shows a case in which the light powers of the laser beams that are emitted from the light emitting elements 1 and N ($LD_1$ and $LD_N$) and are incident on the BD sensor 207 change from a light power 1201 to a light power 1202, and from a light power 1211 to a light power 1212 respectively. Note that the light power 1201 and the light power 1211 are at the same level, and the light power 1202 and the light power 1212 are at the same level.

As shown in FIG. 12, even if the light power incident on the BD sensor 207 changes, the time interval between the BD signals that correspond to the light emitting elements 1 and N and are emitted from the BD sensor do not change (DT1=DT1'). In the case where the BD sensor 207 has this kind of characteristic, the light powers of the light emitting elements 1 and N at the time of beam interval measurement may be controlled so as to be relatively equal light powers. According to this, it is possible to maintain the correction accuracy of the image writing start positions for the light emitting elements without allowing measurement errors to occur in the beam interval measurement.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-137467, filed Jun. 28, 2013, which is hereby incorporated by reference herein in its entirety.

What is claimed is:

1. An image forming apparatus in which a plurality of light beams are deflected such that the plurality of light beams scan a photosensitive member, the image forming apparatus comprising:

a light source including a plurality of light emitting elements that each emit a light beam;

a light power control unit configured to control a light power of light beam that are to be emitted from each of the plurality of light emitting elements;

a detection unit, that is provided on a scanning path of the plurality of light beams have been deflected, configured to output a detection signal indicating that a light beam has been detected due to the light beam being incident on the detection unit;

a measuring unit configured to control the light source such that first and second light beams emitted from first and second light emitting elements among the plurality of light emitting elements are sequentially incident on the detection unit, and to measure a time interval between detection signals that correspond to the first and second light beams and are output from the detection unit; and a timing control unit configured to control relative emission timings of light beams emitted from the plurality of light emitting elements, according to the time interval measured by the measuring unit, wherein the light power control unit is configured to control light powers of the first and second light beams that are to be incident on the detection unit, so as to be a pre-determined light power, the image forming apparatus further comprising:

a storage unit configured to store a reference value that is to be a reference for control performed by the timing control unit, and timing values that are determined in association with the reference value and indicate respective emission timings for the plurality of light emitting elements, and a setting unit configured to set a target light power for the plurality of light beams at a time of scanning an image region on the photosensitive member in which an electrostatic latent image is to be formed, wherein the timing control unit is configured to control the relative emission timings for the plurality of light emitting elements using a value obtained by correcting the timing values according to a difference between the time interval measured by the measuring unit and the reference value, the pre-determined light power is set to a light power that is equal to the target light power set by the setting unit, the reference value and the timing values are generated in advance in correspondence with each of a plurality of levels that can be set as the target light power by the setting unit, and are stored in the storage unit, and the timing control unit is configured to use the reference value and the timing values corresponding to the target light power set by the setting unit to control the relative emission timings for the plurality of light emitting elements.

2. The image forming apparatus according to claim 1, wherein the light power control unit is configured to, when measurement is to be performed by the measurement unit, control light powers of light beams emitted by the first and second light emitting elements so as to be equal to each other before the first and second light beams are emitted.

3. The image forming apparatus according to claim 1, wherein the plurality of light emitting elements are arranged in a linear array in the light source, and the first and second light emitting elements are light emitting elements respectively arranged at two ends of the plurality of light emitting elements.

4. The image forming apparatus according to claim 1, wherein the timing control unit is configured to control the relative emission timings for the plurality of light emitting elements such that positions at which formation of an electrostatic latent image is started coincide between a plurality of main scanning lines scanned by the plurality of light beams.

5. The image forming apparatus according to claim 1, further comprising:

the photosensitive member;

a charging unit configured to charge the photosensitive member; and a developing unit configured to form an image that is to be transferred onto a recording medium on the photosensitive member by developing an electrostatic latent image on the photosensitive member by scanning of the plurality of light beams.

6. An image forming apparatus in which a plurality of light beams are deflected such that the plurality of light beams scan a photosensitive member, the image forming apparatus comprising:

a light source including a plurality of light emitting elements that each emit a light beam;

a light power control unit configured to control a light power of light beam that are to be emitted from each of the plurality of light emitting elements;

a detection unit, that is provided on a scanning path of the plurality of light beams have been deflected, configured to output a detection signal indicating that a light beam has been detected due to the light beam being incident on the detection unit;

a measuring unit configured to control the light source such that first and second light beams emitted from first and second light emitting elements among the plurality of light emitting elements are sequentially incident on the detection unit, and to measure a time interval between detection signals that correspond to the first and second light beams and are output from the detection unit; and a timing control unit configured to control relative emission timings of light beams emitted from the plurality of light emitting elements, according to the time interval measured by the measuring unit, wherein the light power control unit is configured to control light powers of the first and second light beams that are to be incident on the detection unit, so as to be a pre-determined light power, the pre-determined light power is determined in advance as a light power that is independent from the target light power for the plurality of light beams at a time of scanning an image region on the photosensitive member in which an electrostatic latent image is to be formed, and the light power control unit is configured to, when measurement is to be performed by the measurement unit, control a light power of a light beam emitted by each of the first and second light emitting elements so as to be the pre-determined light power, in order that a light power of each of the first and second light beams is to be a constant light power independent of the target light power, the image forming apparatus further comprising a setting unit configured to set a target light power for the plurality of light beams at a time of scanning an image region on the photosensitive member in which an electrostatic latent image is to be formed, wherein the light power control unit is configured to, in a period in which measurement is not performed by the measurement unit, control a light power of a light beam emitted by each of the first and second light emitting elements so as to be the target light power set by the setting unit.

7. The image forming apparatus according to claim 6, wherein the light power control unit is configured to, when measurement is to be performed by the measurement unit, control light powers of light beams emitted by the first and second light emitting elements so as to be equal to each other before the first and second light beams are emitted.

8. The image forming apparatus according to claim 6, wherein the plurality of light emitting elements are arranged in a linear array in the light source, and the first and second light emitting elements are light emitting elements respectively arranged at two ends of the plurality of light emitting elements.

9. The image forming apparatus according to claim 6, further comprising:

the photosensitive member;

a charging unit configured to charge the photosensitive member; and a developing unit configured to form an image that is to be transferred onto a recording medium on the photosensitive member by developing an electrostatic latent image on the photosensitive member by scanning of the plurality of light beams.

10. An image forming apparatus in which a plurality of light beams are deflected such that the plurality of light beams scan a photosensitive member, the image forming apparatus comprising:

a light source including a plurality of light emitting elements that each emit a light beam;

a light power control unit configured to control a light power of light beam that are to be emitted from each of the plurality of light emitting elements;

a detection unit, that is provided on a scanning path of the plurality of light beams have been deflected, configured to output a detection signal indicating that a light beam has been detected due to the light beam being incident on the detection unit;

a measuring unit configured to control the light source such that first and second light beams emitted from first and second light emitting elements among the plurality of light emitting elements are sequentially incident on the detection unit, and to measure a time interval between detection signals that correspond to the first and second light beams and are output from the detection unit; and a timing control unit configured to control relative emission timings of light beams emitted from the plurality of light emitting elements, according to the time interval measured by the measuring unit, wherein the light power control unit is configured to control light powers of the first and second light beams that are to be incident on the detection unit, so as to be a pre-determined light power, and wherein the light power control unit is configured to, when measurement is to be performed by the measurement unit, execute light power control for the first and second light emitting elements with priority over light power control for other light emitting elements among the plurality of light emitting elements.

11. The image forming apparatus according to claim 10, wherein the light power control unit is configured to, when measurement is to be performed by the measurement unit, control light powers of light beams emitted by the first and second light emitting elements so as to be equal to each other before the first and second light beams are emitted.

12. The image forming apparatus according to claim 10, wherein the plurality of light emitting elements are arranged in a linear array in the light source, and the first and second light emitting elements are light emitting elements respectively arranged at two ends of the plurality of light emitting elements.

13. The image forming apparatus according to claim 10, further comprising:

the photosensitive member;

a charging unit configured to charge the photosensitive member; and a developing unit configured to form an image that is to be transferred onto a recording medium on the photosensitive member by developing an electrostatic latent image on the photosensitive member by scanning of the plurality of light beams.

* * * * *